US007557674B2

(12) United States Patent
Kamitsuna

(10) Patent No.: US 7,557,674 B2
(45) Date of Patent: Jul. 7, 2009

(54) MATRIX SWITCH

(75) Inventor: Hideki Kamitsuna, Kanagawa (JP)

(73) Assignee: Nippon Telephone and Telegraph Corporation, Tokyo (JP)

( * ) Notice: Subject to any disclaimer, the term of this patent is extended or adjusted under 35 U.S.C. 154(b) by 120 days.

(21) Appl. No.: 11/587,287

(22) PCT Filed: Mar. 7, 2006

(86) PCT No.: PCT/JP2006/304361

§ 371 (c)(1),
(2), (4) Date: Oct. 18, 2006

(87) PCT Pub. No.: WO2006/095729

PCT Pub. Date: Sep. 14, 2006

(65) Prior Publication Data

US 2007/0241837 A1 Oct. 18, 2007

(30) Foreign Application Priority Data

Mar. 9, 2005 (JP) ..... 2005-065824

(51) Int. Cl.
*H01P 1/10* (2006.01)
*H01P 1/15* (2006.01)
*H01P 5/12* (2006.01)

(52) U.S. Cl. ..... 333/104; 333/101; 333/103

(58) Field of Classification Search ..... 333/101, 333/103, 104, 105, 262
See application file for complete search history.

(56) References Cited

U.S. PATENT DOCUMENTS 5,446,424 A * 8/1995 Pierro ..... 333/104
6,323,742 B1 11/2001 Ke (Continued)

FOREIGN PATENT DOCUMENTS

JP 05-129803 A 5/1993

(Continued)

OTHER PUBLICATIONS

Schindler et al., "DC-20 GHz N x M Passive Switches", IEEE Transactions on Microwave Theory and Techniques, vol. 36, No. 12, Dec. 1988, pp. 1604-1613.

(Continued)

*Primary Examiner*—Dean O Takaoka
(74) *Attorney, Agent, or Firm*—Blakely, Sokoloff, Taylor & Zafman LLP

(57) ABSTRACT

Four SP4T switches ($\mathbf{3}_1$-$\mathbf{3}_4$) are grouped in twos to form two switch pairs. First conductive lines ($\mathbf{4}_{11}$-$\mathbf{4}_{14}$, $\mathbf{4}_{21}$-$\mathbf{4}_{24}$) are arranged in fours between the SP4T switches ($\mathbf{3}_1$, $\mathbf{3}_4$; $\mathbf{3}_2$, $\mathbf{3}_3$) constituting the switch pairs. Each of four second conductive lines ($\mathbf{5}_1$-$\mathbf{5}_4$) connects to a corresponding one of different conductive lines of the first conductive lines which connect to the respective switch pairs. The first and second conductive lines are arranged on a dielectric layer having a lower surface on which a ground conductor (6) is formed. The dielectric, layer has a two-layer structure. The first conductive lines are arranged on the first dielectric layer as a lower layer. The second conductive lines are arranged on the second dielectric layer as an upper layer. This arrangement makes it possible to attain a reduction in the size of a matrix switch and a reduction in loss and allow broadband operation.

17 Claims, 16 Drawing Sheets

U.S. PATENT DOCUMENTS

| | | | | |
|---|---|---|---|---|
| 6,614,325 | B1 | 9/2003 | Kocin | |
| 6,888,420 | B2 * | 5/2005 | Schaffner et al. | 333/101 |
| 7,205,864 | B2 * | 4/2007 | Schultz et al. | 333/104 |
| 2002/0063475 | A1 | 5/2002 | Freeston et al. | |

FOREIGN PATENT DOCUMENTS

| | | | |
|---|---|---|---|
| JP | 05-327230 | A | 12/1993 |
| JP | 06-232604 | A | 8/1994 |
| JP | 07-046103 | A | 2/1995 |
| JP | 07-050559 | A | 2/1995 |
| JP | 07-222215 | A | 8/1995 |
| JP | 08-008602 | | 1/1996 |
| JP | 08-242078 | A | 9/1996 |
| JP | 09-009312 | A | 1/1997 |
| JP | 09-116310 | A | 5/1997 |
| JP | 2000-223903 | A | 8/2000 |
| JP | 2002-280811 | A | 9/2002 |
| JP | 2003-017991 | A | 1/2003 |
| JP | 2005-236525 | A | 9/2005 |
| JP | 2005-323304 | | 11/2005 |
| WO | WO 01/20688 | A | 3/2001 |
| WO | WO 2004/068922 | | 8/2004 |

OTHER PUBLICATIONS

Daneshmand et al., "Integrated Interconnect Networks for RF Switch Matrix Applications", IEEE Transactions on Microwave Theory and Techniques, vol. 53, No. 1, Jan. 2005, pp. 12-21.

Kamitsuna et al., "A Miniaturized Wideband 4x4 Switch Matrix IC Using Four InP-HEMT SP4T Switches", IEEE, 2005, pp. 2015-2018.

* cited by examiner

MATRIX SWITCH

The present patent application is a non-provisional application claiming the benefit of International Application No. PCT/JP2006/304361, filed Mar. 7, 2006.

TECHNICAL FIELD

The present invention relates to a matrix switch which outputs a signal from an arbitrary input terminal to an arbitrary output terminal by switching signal paths between a plurality of input terminals and a plurality of output terminals and, more particularly, to a matrix switch including a plurality of 1×n switches (n is an even number equal to or more than 2).

BACKGROUND ART

A multi-input/multi-output matrix switch is used to, for example, switch signal paths at nodes in a network. A conventional n-input/n-output switch comprises n 1-input/n-output switches, n n-input/1-output switches, and $n^2$ connection means for connecting the switches to each other. Reference 1 (Japanese Patent Laid-Open No. 9-9312) discloses an example of such an n-input/n-output switch. The n-input/n-output switch disclosed in reference 1 has an arrangement which can be applied as a cross-connect switch which can output input signals from n input terminals $\mathbf{101}_1$ to $\mathbf{101}_n$ in all combinations to n output terminals $\mathbf{102}_1$ to $\mathbf{102}_n$, as shown in FIG. 19. This arrangement will be described in more detail below by exemplifying the case of n=4.

As shown in FIG. 20, a conventional 4-input/4-output switch (4×4 switch) includes eight Single-Pole 4-Throw (SP4T) switches $\mathbf{103}_1$ to $\mathbf{103}_8$ in correspondence with input terminals $\mathbf{101}_1$ to $\mathbf{101}_4$ and output terminals $\mathbf{102}_1$ to $\mathbf{102}_4$. The SP4T switches $\mathbf{103}_1$ to $\mathbf{103}_8$ are bidirectional switches, each functioning both as an 1-input/4-output switch and a 4-input/1-output switch.

Each of the SP4T switches $\mathbf{103}_1$ to $\mathbf{103}_8$ includes one common terminal and four individual terminals. Sixteen interconnection transmission lines $\mathbf{104}_{11}$ to $\mathbf{104}_{44}$ connect the individual terminals of the SP4T switches $\mathbf{103}_1$ to $\mathbf{103}_4$ on the input side to the individual terminals of the SP4T switches $\mathbf{103}_5$ to $\mathbf{103}_8$ on the output side. Each of the SP4T switches $\mathbf{103}_1$ to $\mathbf{103}_8$ is designed such that the common terminal connects to one of the four individual terminals (does not connect to the remaining three terminals). These switches are controlled as a whole such that the four input terminals $\mathbf{10}_{11}$ to $\mathbf{10}_{14}$ one-to-one connect to the four output terminals $\mathbf{102}_1$ to $\mathbf{102}_4$. Referring to FIG. 20, the symbol "○" with a satin-like pattern indicates an interconnection intersection 116 where two transmission lines intersect each other but do not electrically connect to each other.

DISCLOSURE OF INVENTION

Problem to be Solved by the Invention

The following problems arise in the conventional matrix switch.

The first problem is that it is difficult to achieve low insertion loss and high isolation while reducing the circuit size. This problem originates from the necessity to make the interconnection transmission lines $\mathbf{104}_{11}$ to $\mathbf{104}_{44}$ have finite lengths and not a little increase in insertion loss caused by the finite lengths. When the transmission lines $\mathbf{104}_{11}$ to $\mathbf{104}_{44}$ comprise, for example, coplanar waveguides, in order to reduce insertion loss, it is necessary to increase the central conductor width and the gap between the central conductor and the ground conductor. This is because the characteristic impedance of a coplanar waveguide is almost uniquely determined by the central conductor width and the above gap.

On the other hand, a matrix switch is required to have a high isolation characteristic between the respective paths. In this case, the isolation between coplanar waveguides increases as the ground conductor width between the lines increases. In order to attain characteristics with a low insertion loss and high isolation, it is necessary to increase both the central conductor width and the ground conductor width. However, in a matrix switch in which transmission lines are arranged at a high density, each connection path inevitably becomes long. This greatly cancels out the above reducing effect of insertion loss.

An increase in the length of connection paths amounts to an increase in circuit size. When a matrix switch is to be integrated on a semiconductor substrate, in particular, this increase in circuit size causes an increase in cost. Letting n be the numbers of input terminals $\mathbf{101}_1$ to $\mathbf{101}_n$ and output terminals $\mathbf{102}_1$ to $\mathbf{102}_n$, the required number of connection paths is the square of n. Therefore, the larger the switch size, the more conspicuous these problems become. This poses a serious problem in the matrix switch with a size of 4×4 or more shown in FIG. 20.

The second problem is that as the numbers of input terminals $\mathbf{101}_1$ to $\mathbf{101}_n$ and output terminals $\mathbf{102}_1$ to $\mathbf{102}_n$ increase, the number of connection path intersections increases, and the isolation characteristic deteriorates. In the 4×4 switch shown in FIG. 20, there are as many as 36 interconnection intersections. The number of interconnection intersections in an 8×8 switch reaches as many as 784. As described above, the larger the size of a matrix switch, the larger the number of interconnection intersections becomes, resulting in a deterioration in isolation characteristic.

The third problem is that an increase in the number of switch control lines will cause a deterioration in isolation characteristic. This problem originates from the necessity to provide switches on both the input and output sides. If SPnT switches each functioning both as a 1-input/n-output switch and an n-input/1-output switch require n control lines each, a 4×4 switch requires 32 control lines, and an 8×8 switch requires as many as 128 control lines. These control lines inevitably intersect the interconnection transmission lines $\mathbf{104}_{11}$ to $\mathbf{104}_{44}$. This leads to a deterioration in isolation characteristic.

The fundamental cause of the above problems in the prior art is that n 1-input/n-output switches and n n-input/1-output switches are respectively arranged on both the input and output sides. That is, the problems originate from the necessity of $n^2$ interconnection transmission lines for connecting these switches.

This conventional matrix switch operates even if the switches on either the input side or the output side are removed. For example, even if the SP4T switches $\mathbf{103}_5$ to $\mathbf{103}_8$ on the output side in FIG. 20 are removed, the resultant structure operates as a 4×4 switch. In this case, however, transmission lines coupled to the OFF terminals of the SP4T switches $\mathbf{103}_1$ to $\mathbf{103}_4$ on the input side become open stubs when viewed from the output terminals $\mathbf{102}_1$ to $\mathbf{102}_4$. An OFF terminal is an individual terminal which does not connect to a common terminal. An open stub is a portion which branches off from a main transmission line and has an open end. A 4×4 switch has three open stubs for each output terminal, and an 8×8 switch has seven open stubs for each output terminal. Open stubs increase capacitance. As a result, return loss increases with an increase in frequency. This makes it difficult to perform broadband operation at several GHz or more.

Decreasing the length of an open stub makes it possible to reduce the capacitance caused by the open stub. The length of an open stub almost corresponds to the interval between an input-side switch and an output-side switch. As the interval between two switches, a 4×4 switch requires a length corresponding a space where at least 16 interconnection transmission lines are arranged, and an 8×8 switch requires a space where 64 interconnection transmission lines are arranged. The length of an open stub can therefore decrease as the width of a transmission line and a transmission line interval decrease. However, consideration must be given to the tradeoff with insertion loss and isolation characteristic.

The capacitance caused by an open stub can also be reduced by increasing the characteristic impedance of an interconnection transmission line. For example, however, in order to increase the characteristic impedance of a coplanar waveguide, the interval between the central conductor and the ground conductor must be increased. This leads to an increase in the length of an interconnection transmission line which becomes an open stub, and greatly cancels out the characteristic impedance increasing effect.

It is, therefore, an object of the present invention to downsize a matrix switch.

It is another object of the present invention to reduce the insertion loss of a matrix switch.

It is still another object of the present invention to improve the isolation characteristic of a matrix switch.

It is still another object of the present invention to enable a matrix switch to perform broadband operation.

Means of Solution to the Problem

In order to achieve the above objects, a matrix switch according to the present invention is characterized by comprising n (n is an even umber not less than 2) 1×n switches which are grouped in twos to form switch pairs, first conductive lines arranged in ns for each switch pair, n second conductive lines which respectively connect to different lines of the first conductive lines which are respectively arranged on the switch pairs, a dielectric layer on which the first conductive lines and the second conductive lines are separately arranged on not less than two layers, and a ground conductor which forms a transmission line together with at least one of the first conductive line and the second conductive line and the dielectric layer, wherein the 1×n switch comprises one common terminal and n individual terminals arranged on a side different from that of the common terminal, two 1×n switches forming the switch pair are arranged such that individual terminals of the 1×n switches are spaced apart from each other to face each other, and the first conductive lines connect the respective individual terminals of the two 1×n switches to each other.

Effects of the Invention

According to the present invention, the number of conductive lines existing between two 1×n switches forming a switch pair can decrease from $n^2$ in the prior art to n. When conductive lines with the same line width and the same line interval as those in the prior art are used, the space where the conductive lines are arranged decreases. Since a required 1×n switch reduces to ½ that in the prior art, the matrix switch can be reduced in size. A reduction in size can achieve a reduction in cost.

In addition, decreasing the interval between the two 1×n switches to 1/n that in the prior art makes it possible to decrease the length of open stubs. This reduces the capacitance caused by the open stubs and hence allows operation in a broad bandwidth of several GHz or more.

Furthermore, since the transmission line length between an input terminal and an output terminal in the ON state decreases, insertion loss decreases, and the path dependency of insertion loss decreases.

Moreover, since the number of interconnection intersections decreases, the isolation characteristic improves.

BEST MODE FOR CARRYING OUT THE INVENTION

The embodiments of the present invention will be described in detail below with reference to the accompanying drawings.

First Embodiment

Figure 1:
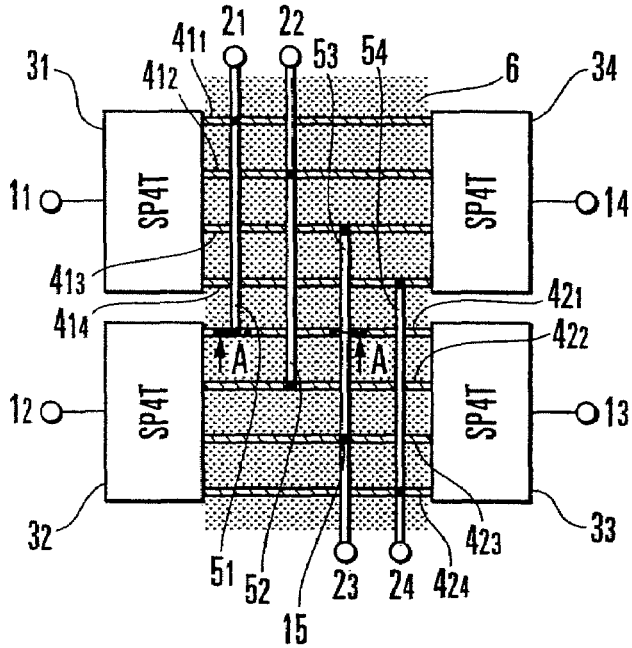
FIG. 1 is a block diagram showing the arrangement of a matrix switch according to the first embodiment of the present invention.

As shown in FIG. 1, a matrix switch according to the first embodiment of the present invention is a 4×4 switch including four input terminals (first terminals) $\mathbf{1}_1$ to $\mathbf{1}_4$, four output terminals (second terminals) $\mathbf{2}_1$ to $\mathbf{2}_4$, and four SP4T switches $\mathbf{3}_1$ to $\mathbf{3}_4$.

Figure 2:
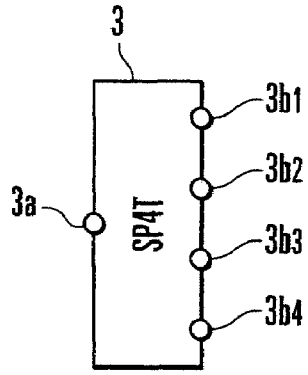
FIG. 2 is a view showing the arrangement of an SP4T switch.

Each of the SP4T switches $\mathbf{3}_1$ to $\mathbf{3}_4$ is a 1×4 switch including one common terminal 3*a* and four individual terminals $\mathbf{3}b_1$ to $\mathbf{3}b_4$ like a SP4T switch 3 shown in FIG. 2. The common terminal 3*a* and the individual terminals $\mathbf{3}b_1$ to $\mathbf{3}b_4$ are arranged on opposite sides of the switch. Each of the SP4T switches $\mathbf{3}_1$ to $\mathbf{3}_4$ is controlled such that the common terminal 3*a* of the self-switch selectively connects to one of the individual terminals $\mathbf{3}b_1$ to $\mathbf{3}b_4$ while not connecting to the remaining three terminals. Therefore, each of the SP4T switches $\mathbf{3}_1$ to $\mathbf{3}_4$ outputs a signal input from the common terminal 3*a* to one of the individual terminals $\mathbf{3}b_1$ to $\mathbf{3}b_4$, and outputs a signal input from one of the individual terminals $\mathbf{3}b_1$ to $\mathbf{3}b_4$ to the common terminal 3*a*. Each of the SP4T switches $\mathbf{3}_1$ to $\mathbf{3}_4$ is a bidirectional switch functioning both as a 1-input/4-output switch and a 4-input/1-output switch. Note that it suffices if the common terminal 3*a* and the individual terminals $\mathbf{3}b_1$ to $\mathbf{3}b_4$ are arranged on different sides of the switch. That is, the terminals 3*a* and $\mathbf{3}b_1$ to $\mathbf{3}b_4$ may be arranged on adjacent sides of the switch.

The four SP4T switches $\mathbf{3}_1$ to $\mathbf{3}_4$ are grouped in twos to form two switch pairs. More specifically, the SP4T switches $\mathbf{3}_1$ and $\mathbf{3}_4$ constitute the first switch pair, and the SP4T switches $\mathbf{3}_2$ and $\mathbf{3}_3$ constitute the second switch pair. The SP4T switches $\mathbf{3}_1$ and $\mathbf{3}_4$ constituting the first switch pair are arranged such that the individual terminals $\mathbf{3}b_1$ to $\mathbf{3}b_4$ of one switch face those of the other switch. The SP4T switches $\mathbf{3}_2$ and $\mathbf{3}_3$ constituting the second switch pair are arranged in the same manner.

In the first switch pair, the four individual terminals $\mathbf{3}b_1$ to $\mathbf{3}b_4$ of the SP4T switch $\mathbf{3}_1$ connect to the four individual terminals $\mathbf{3}b_1$ to $\mathbf{3}b_4$ of the SP4T switch $\mathbf{3}_4$ via four first conductive lines $\mathbf{4}_{11}$ to $\mathbf{4}_{14}$. Likewise, in the second switch pair, the four individual terminals $\mathbf{3}b_1$ to $\mathbf{3}b_4$ of the SP4T switch $\mathbf{3}_2$ connect to the four individual terminals $\mathbf{3}b_1$ to $\mathbf{3}b_4$ of the SP4T switch $\mathbf{3}_3$ via four first conductive lines $\mathbf{4}_{21}$ to $\mathbf{4}_{24}$. The first conductive lines $\mathbf{4}_{11}$ to $\mathbf{4}_{14}$ and $\mathbf{4}_{21}$ to $\mathbf{4}_{24}$ are arranged parallel to each other.

The first conductive lines $\mathbf{4}_{11}$ to $\mathbf{4}_{14}$ respectively connect to the first conductive lines $\mathbf{4}_{21}$ to $\mathbf{4}_{24}$ via second conductive lines $\mathbf{5}_1$ to $\mathbf{5}_4$. More specifically, the first conductive lines $\mathbf{4}_{11}$ and $\mathbf{4}_{21}$ connect to each other via the second conductive line $\mathbf{5}_1$; the first conductive lines $\mathbf{4}_{12}$ and $\mathbf{4}_{22}$, via the second conductive line $\mathbf{5}_2$; the first conductive lines $\mathbf{4}_{13}$ and $\mathbf{4}_{23}$, via the second conductive line $\mathbf{5}_3$; and the first conductive lines $\mathbf{4}_{14}$ and $\mathbf{4}_{24}$, via the second conductive line $\mathbf{5}_4$. The second conductive lines $\mathbf{5}_1$ to $\mathbf{5}_4$ are arranged parallel to each other in a direction to intersect the first conductive lines $\mathbf{4}_{11}$ to $\mathbf{4}_{14}$ and $\mathbf{4}_{21}$ to $\mathbf{4}_{24}$ (a direction to perpendicular to them in FIG. 1).

The input terminals $\mathbf{1}_1$ to $\mathbf{1}_4$ to which signals are input connect to the common terminals 3*a* of the SP4T switches $\mathbf{3}_1$ to $\mathbf{3}_4$. End portions of the second conductive lines $\mathbf{5}_1$ to $\mathbf{5}_4$ are extracted outside the area where the conductive lines $\mathbf{4}_{11}$ to $\mathbf{4}_{14}$ and $\mathbf{4}_{21}$ to $\mathbf{4}_{24}$ are arranged and connect to the output terminals $\mathbf{2}_1$ to $\mathbf{2}_4$ from which signals are output. The SP4T switches $\mathbf{3}_1$ to $\mathbf{3}_4$ are controlled as a whole such that the four input terminals $\mathbf{1}_1$ to $\mathbf{1}_4$ one-to-one connect to the four output terminals $\mathbf{2}_1$ to $\mathbf{2}_4$.

A cross-sectional arrangement of the matrix switch shown in FIG. 1 will be described next with reference to FIG. 3. The first conductive lines $\mathbf{4}_{11}$ to $\mathbf{4}_{14}$ and $\mathbf{4}_{21}$ to $\mathbf{4}_{24}$ and the second conductive lines $\mathbf{5}_1$ to $\mathbf{5}_4$ constitute microstrip lines (transmission lines) together with a ground conductor 6 formed on a substrate 9 and a dielectric layer 8 formed on the ground conductor 6.

The dielectric layer 8 has a two-layer structure comprising a first dielectric layer $\mathbf{8}_1$ and a second dielectric layer $\mathbf{8}_2$. The first dielectric layer $\mathbf{8}_1$ is stacked on the ground conductor 6, and the second dielectric layer $\mathbf{8}_2$ is stacked on the first dielectric layer $\mathbf{8}_1$. The first conductive lines $\mathbf{4}_{11}$ to $\mathbf{4}_{14}$ and $\mathbf{4}_{21}$ to $\mathbf{4}_{24}$ are arranged on the first dielectric layer $\mathbf{8}_1$, and the second conductive lines $\mathbf{5}_1$ to $\mathbf{5}_4$ are arranged on the second dielectric layer $\mathbf{8}_2$. The first conductive lines $\mathbf{4}_{13}$ to $\mathbf{4}_{14}$ and $\mathbf{4}_{21}$ to $\mathbf{4}_{24}$ connect to the second conductive lines $\mathbf{5}_1$ to $\mathbf{5}_4$ at connecting portions 15 indicated by "■" in FIG. 1 via through holes $\mathbf{7}_1$ formed in the second dielectric layer $\mathbf{8}_2$. Although reference numeral "15" denoting a connecting portion is attached to only one symbol "■" in FIG. 1, the remaining symbols "■" indicate the connecting portions 15. This applies to FIGS. 4, 14, 16, and 18 to be described later. FIG. 3 is a view for explaining a state wherein two conductive lines connect to each other via a dielectric layer, with an illustration of the second conductive line $\mathbf{5}_4$ being omitted.

Figure 4:
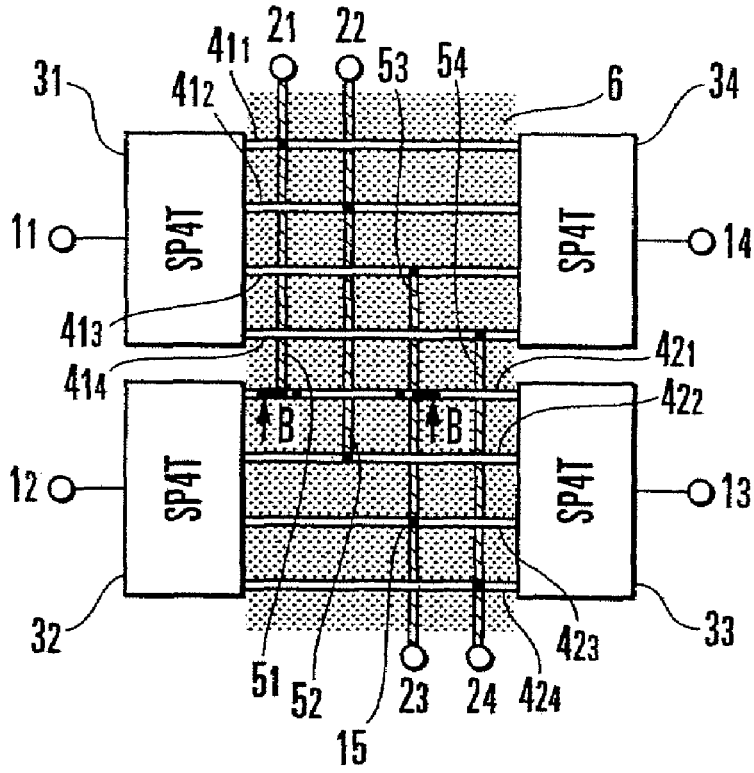
FIG. 4 is a block diagram showing a modification of the matrix switch shown in FIG. 1.
Figure 20:
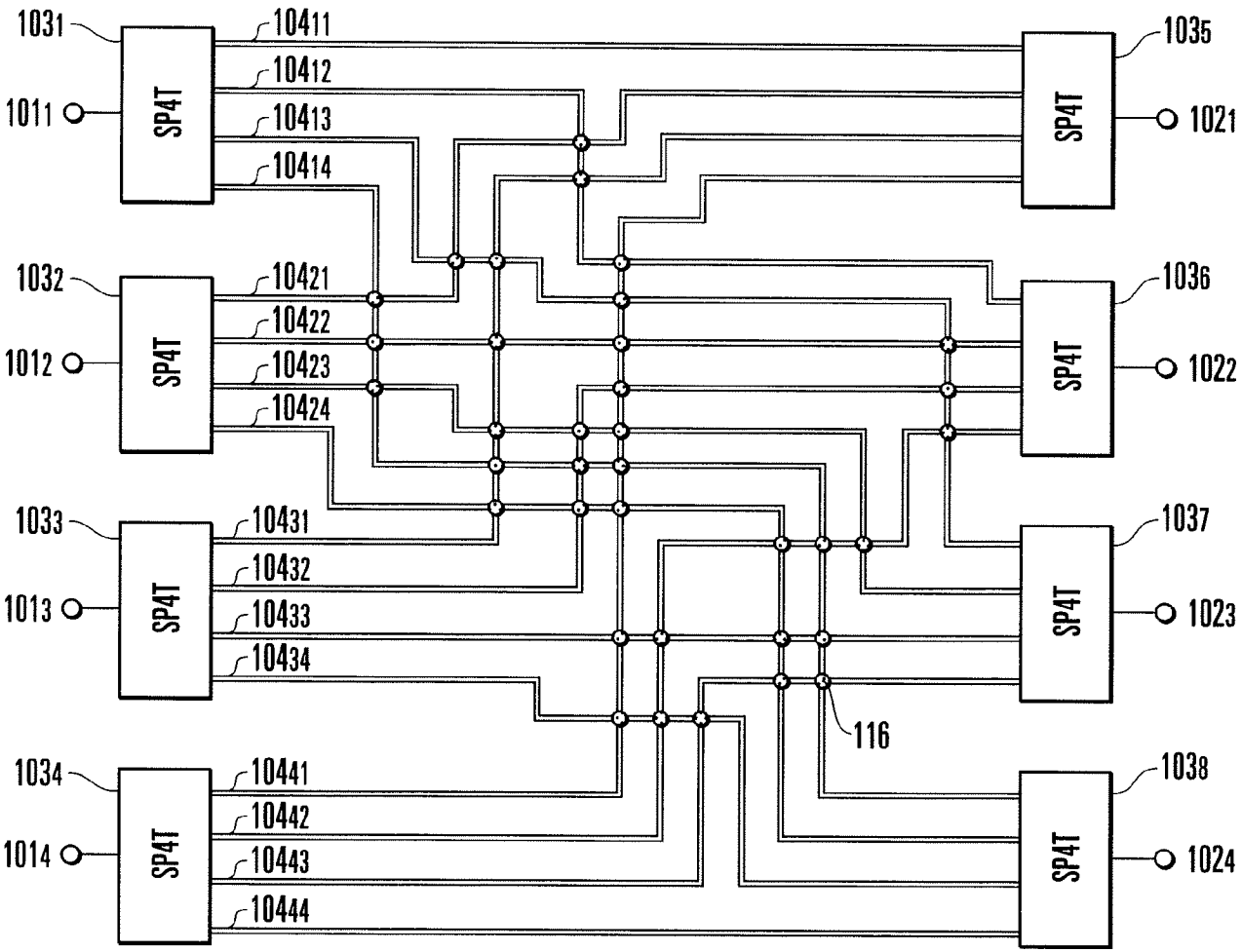
FIG.20 (PRIOR ART)
FIG. 20 is a block diagram showing the arrangement of a conventional 4×4 switch.

The above arrangement makes it possible to decrease the number of conductive lines existing between the opposite switches of the respective switch pairs from 16 in the prior art shown in FIGS. 20 to 4 (the second conductive lines $\mathbf{5}_1$ to $\mathbf{5}_4$). If, therefore, conductive lines with the same line width and the same line interval are used, the interval between the SP4T switches $\mathbf{3}_1$ and $\mathbf{3}_4$ and between the SP4T switches $\mathbf{3}_2$ and $\mathbf{3}_3$ of the first and second switch pairs can decrease to about ¼ that in the prior art.

At switching operation, in each of the SP4T switches $\mathbf{3}_1$ to $\mathbf{3}_4$, the first conductive lines coupled to the OFF terminals become open stubs, together with some of the second conductive lines in some case. Therefore, at switching operation, three open stubs exist for each of the output terminals $\mathbf{2}_1$ to $\mathbf{2}_4$. As described above, decreasing the interval between the SP4T switches $\mathbf{3}_1$ and $\mathbf{3}_4$ and between the SP4T switches $\mathbf{3}_2$ and $\mathbf{3}_3$ makes it possible to decrease the length of each open stub to about 1/12 that in the prior art. This allows broadband operation in a bandwidth 10 times or more as wide as that in the arrangement of the prior art in which the SP4T switches $\mathbf{103}_5$ to $\mathbf{103}_8$ on the output side are removed. Furthermore, since the length of the transmission lines between input terminals and output terminals in the ON state decreases, insertion loss can be reduced while the path dependency of insertion loss can be reduced.

Figure 14:
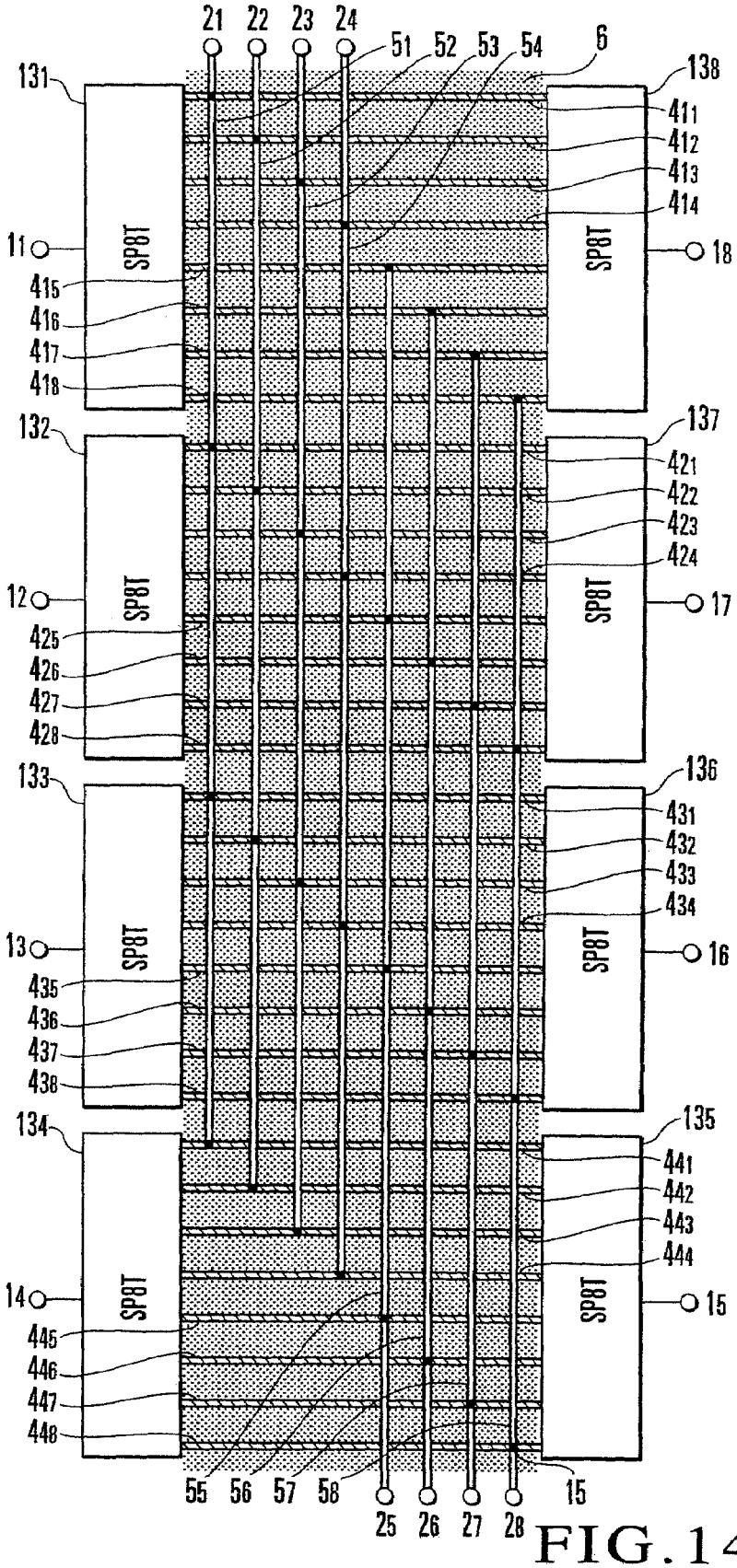
FIG. 14 is a block diagram showing the arrangement of a matrix switch according to the fifth embodiment of the present invention.

In addition, the number of interconnection intersections can decrease from 36 in the prior art shown in FIGS. 20 to 14, and an improvement in isolation characteristic can be attained. Furthermore, for example, as shown in FIG. 3, the ground conductor 6 and the dielectric layers $\mathbf{8}_1$ and $\mathbf{8}_2$ are sequentially formed on the substrate 9, with the dielectric layers $\mathbf{8}_1$ and $\mathbf{8}_2$ having a thickness of several μm to several ten μm. This structure makes it possible to maintain high interline isolation even if the line interval is decreased as compared with microstrip lines using a substrate lower surface ground and coplanar waveguides formed on a substrate upper surface. Therefore, a switch with a broader bandwidth can be implemented. Moreover, the above structure can increase a characteristic impedance with a narrow line interval as compared with coplanar waveguides, and hence makes it easy to reduce the capacitance caused by an open stub, thereby improving return loss.

Figure 3:
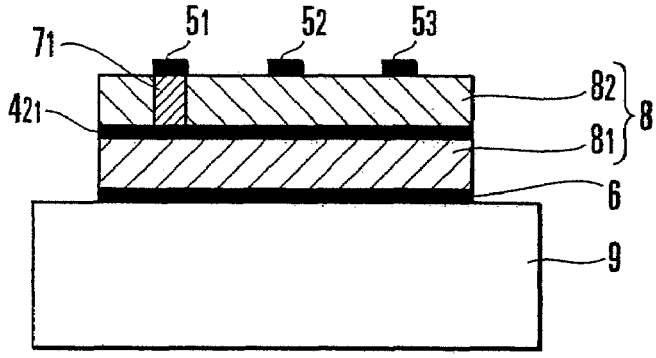
FIG. 3 is a cross-sectional view taken along a line A-A in FIG. 1.
Figure 5:
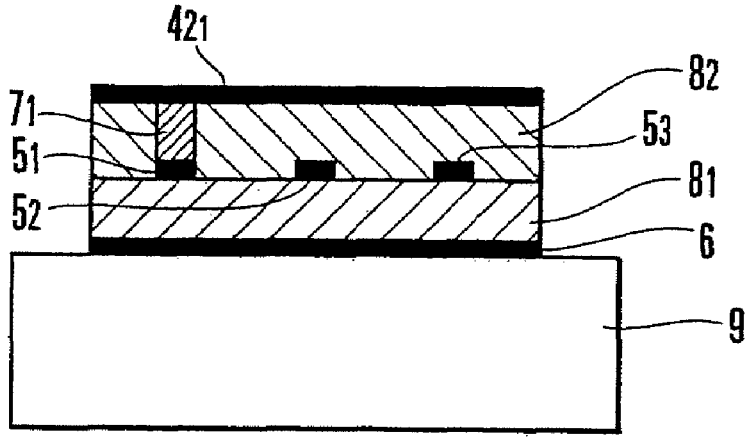
FIG. 5 is a cross-sectional view taken along a line B-B in FIG. 4.

The matrix switch shown in FIGS. 4 and 5 is a modification of the matrix switch shown in FIGS. 1 and 3. The second conductive lines $\mathbf{5}_1$ to $\mathbf{5}_4$ are arranged on the first dielectric layer $\mathbf{8}_1$, and the first conductive lines $\mathbf{4}_{11}$ to $\mathbf{4}_{14}$ and $\mathbf{4}_{21}$ to $\mathbf{4}_{24}$ are arranged on the second dielectric layer $\mathbf{8}_2$. This arrangement can obtain the same effects as those of the matrix switch shown in FIGS. 1 and 3. Note that an illustration of the second conductive line $\mathbf{5}_4$ is omitted in FIG. 5 as well for the same reason as that for FIG. 3.

In the matrix switch shown in FIGS. 3 and 5, the conductive line width on the first dielectric layer $\mathbf{8}_1$ is preferably smaller than that on the second dielectric layer $\mathbf{8}_2$. This makes it possible to reduce the characteristic impedance difference between the conductive lines on the first dielectric layer $\mathbf{8}_1$ and the conductive lines on the second dielectric layer $\mathbf{8}_2$. Both the characteristic impedances can be equalized. This makes it possible to improve the characteristics of the switch.

According to the matrix switch shown in FIGS. 1 and 4, it was confirmed that a 4×4 switch with a bandwidth of about 20 GHz could be implemented by setting the line widths of the first conductive lines $\mathbf{4}_{11}$ to $\mathbf{4}_{14}$ and $\mathbf{4}_{21}$ to $\mathbf{4}_{24}$ and the second conductive lines $\mathbf{5}_1$ to $5_4$ to about 5 to 10 μm, the thicknesses of the lines to about 1 to 5 μm, and the thicknesses of the first and second dielectric layers $\mathbf{8}_1$ and $8_2$ to about 2 to 5 μm (dielectric constant: about 3).

Figure 6:
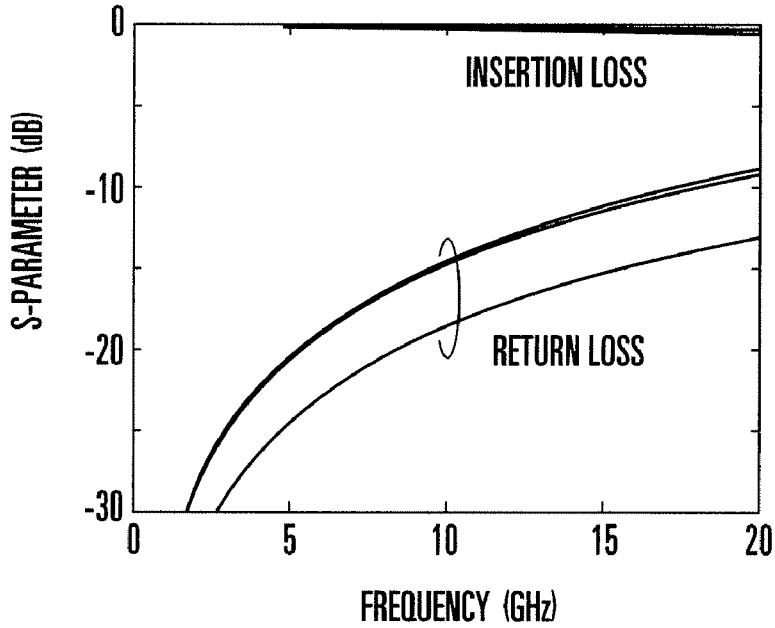
FIG. 6 is a graph showing simulation results on a 4×4 switch according to the first embodiment.
Figure 7:
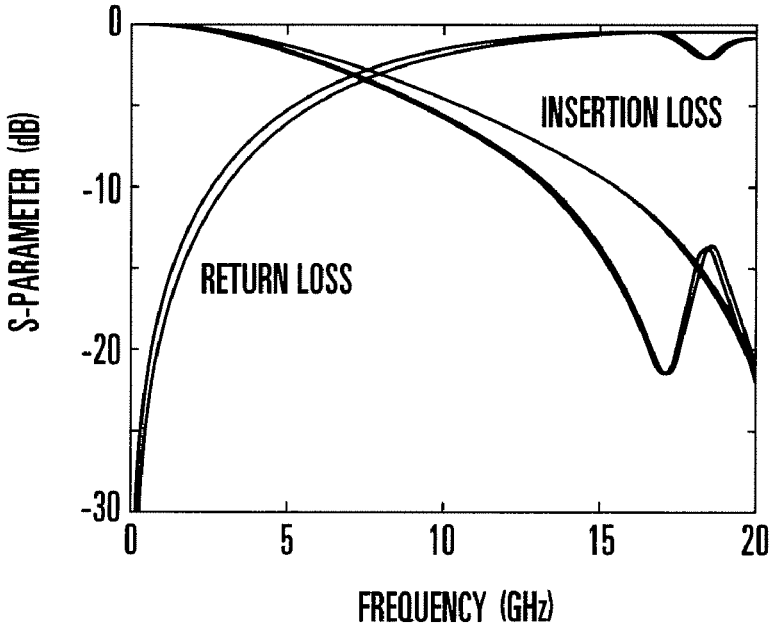
FIG. 7 (PRIOR ART)
FIG. 7 is a graph showing simulation results on a 4×4 switch with a conventional arrangement.

FIG. 6 shows the simulation result obtained from a 4×4 switch designed with the above dimensions. For comparison, FIG. 7 shows the simulation result obtained from a 4×4 switch with a conventional arrangement. In this case, a 4×4 switch with a conventional arrangement is assumed to be the switch obtained by removing the output-side SP4T switches $\mathbf{103}_5$ to $\mathbf{103}_8$ of the matrix switch shown in FIG. 20, and connecting end portions of the interconnection transmission lines $\mathbf{104}_{11}$ to $\mathbf{104}_{14}$, $\mathbf{104}_{21}$ to $\mathbf{104}_{24}$, $\mathbf{104}_{31}$ to $\mathbf{104}_{34}$, and $\mathbf{104}_{41}$ to $\mathbf{104}_{44}$ to which the individual terminals of the SP4T switches $\mathbf{103}_5$ to $\mathbf{103}_8$ have connected.

Bandwidths are compared in which return losses become −10 dB or less. In the conventional arrangement shown in FIG. 7, such a loss appears at 2.7 GHz. In this embodiment, as shown in FIG. 6, such a loss appears at 17 GHz. Obviously, this embodiment greatly broadens the bandwidth in which the return loss becomes −10 dB or less. It was also confirmed that the insertion loss could be greatly improved.

Second Embodiment

Figure 8A:
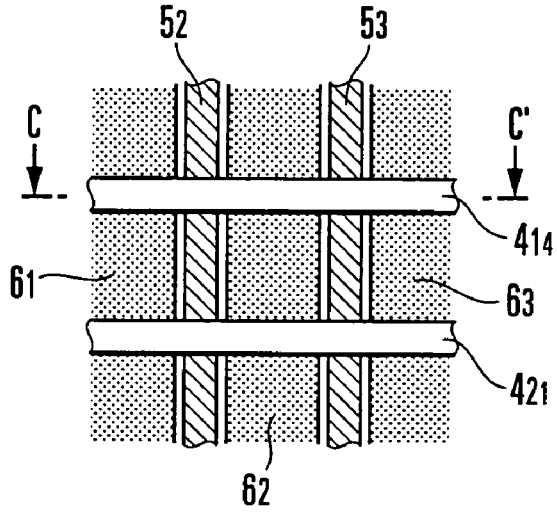
FIG. 8A is a plan view showing an outline of an example of the interconnection structure of a matrix switch according to the second embodiment of the present invention.
Figure 8B:
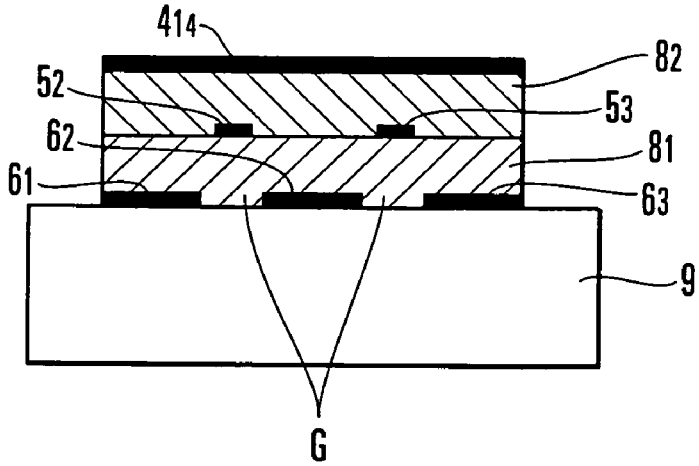
FIG. 8B is a cross-sectional view taken along a line C-C' in FIG. 8A.

The matrix switch shown in FIGS. 8A and 8B is a modification of the matrix switch shown in FIGS. 4 and 5. In this matrix switch, gaps G are formed in a ground conductor 6 immediately below second conductive lines $\mathbf{5}_1$ to $\mathbf{5}_4$ arranged on a first dielectric layer $\mathbf{8}_1$. This reduces the capacitances of the second conductive lines $\mathbf{5}_1$ to $\mathbf{5}_4$, and hence can increase the characteristic impedance without decreasing the line width of the second conductive lines $\mathbf{5}_1$ to $\mathbf{5}_4$.

Preferably, the line width of the second conductive lines $\mathbf{5}_1$ to $\mathbf{5}_4$ on the first dielectric layer $\mathbf{8}_1$ is set to be almost equal to that of first conductive lines $\mathbf{4}_{11}$ to $\mathbf{4}_{14}$ and $\mathbf{4}_{21}$ to $\mathbf{4}_{24}$ on a second dielectric layer $\mathbf{8}_2$, and the widths of the gaps G in the ground conductor 6 are set such that the characteristic impedance of the second conductive lines $\mathbf{5}_1$ to $\mathbf{5}_4$ becomes equal to that of the first conductive lines $\mathbf{4}_{11}$ to $\mathbf{4}_{14}$ and $\mathbf{4}_{21}$ to $\mathbf{4}_{24}$. Referring to FIG. 8, ground conductors $\mathbf{6}_1$, $\mathbf{6}_2$, and $\mathbf{6}_3$ are ground conductors which connect to the same potential.

Figure 9A:
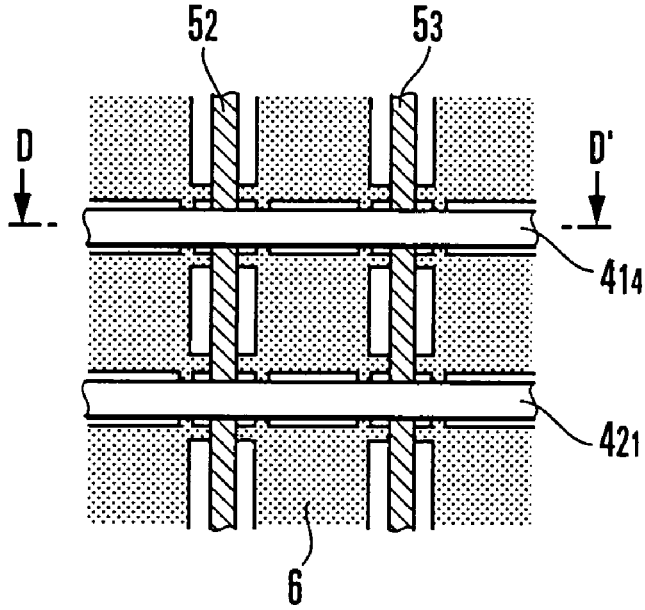
FIG. 9A is a plan view showing an outline of another example of the interconnection structure of the matrix switch according to the second embodiment of the present invention.
Figure 9B:
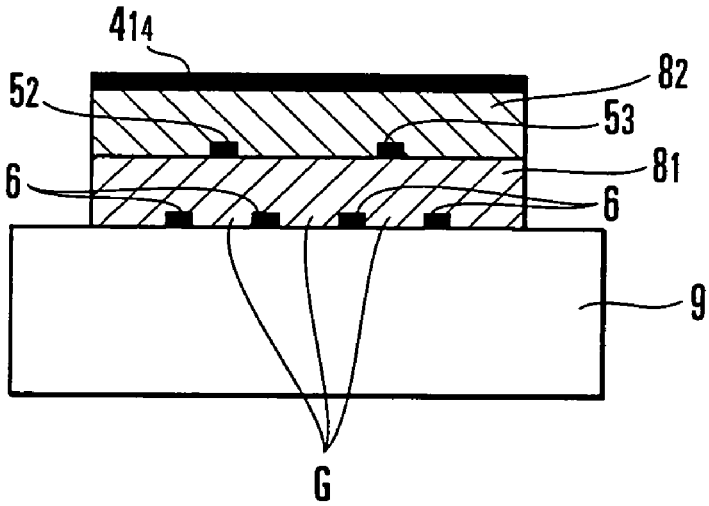
FIG. 9B is a cross-sectional view taken along a line D-D' in FIG. 9A.

The matrix switch shown in FIGS. 9A and 9B is another modification of the matrix switch shown in FIGS. 4 and 5. In this matrix switch, the gaps G are formed in the ground conductor 6 immediately below the first and second conductive lines $\mathbf{4}_{11}$ to $\mathbf{4}_{14}$, $\mathbf{4}_{21}$ to $\mathbf{4}_{24}$, and $\mathbf{5}_1$ to $\mathbf{5}_4$ except for intersection areas between the second conductive lines $\mathbf{5}_1$ to $\mathbf{5}_4$ arranged on the first dielectric layer $\mathbf{8}_1$ and the first conductive lines $\mathbf{4}_{11}$ to $\mathbf{4}_{14}$ and $\mathbf{4}_{21}$ to $\mathbf{4}_{24}$ arranged on the second dielectric layer $\mathbf{8}_2$. This arrangement can further increase the characteristic impedances.

Preferably, the line width of the second conductive lines $\mathbf{5}_1$ to $\mathbf{5}_4$ on the first dielectric layer $\mathbf{8}_1$ is smaller than that of the first conductive lines $\mathbf{4}_{11}$ to $\mathbf{4}_{14}$ and $\mathbf{4}_{21}$ to $\mathbf{4}_{24}$ on the second dielectric layer $\mathbf{8}_2$, and the widths of the gaps G in the ground conductor 6 are set such that the characteristic impedance of the second conductive lines $\mathbf{5}_1$ to $\mathbf{5}_4$ becomes equal to that of the first conductive lines $\mathbf{4}_{11}$ to $\mathbf{4}_{14}$ and $\mathbf{4}_{21}$ to $\mathbf{4}_{24}$. This arrangement can greatly reduce the capacitance caused by open stubs by increasing the characteristic impedances. As a consequence, the return loss can be improved, and hence a matrix switch with a broader bandwidth can be implemented.

Note that this embodiment can also be applied to a case wherein the first conductive lines $\mathbf{4}_{11}$ to $\mathbf{4}_{14}$ and $\mathbf{4}_{21}$ to $\mathbf{4}_{24}$ are arranged on the first dielectric layer $\mathbf{8}_1$, and the second conductive lines $\mathbf{5}_1$ to $\mathbf{5}_4$ are arranged on the second dielectric layer $\mathbf{8}_2$.

Third Embodiment

Figure 10A:
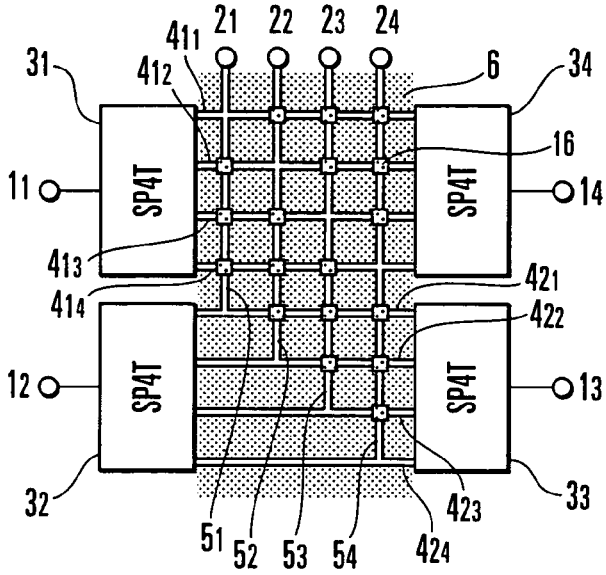
FIG. 10A is a block diagram showing an example of the arrangement of a matrix switch according to the third embodiment of the present invention.
Figure 10B:
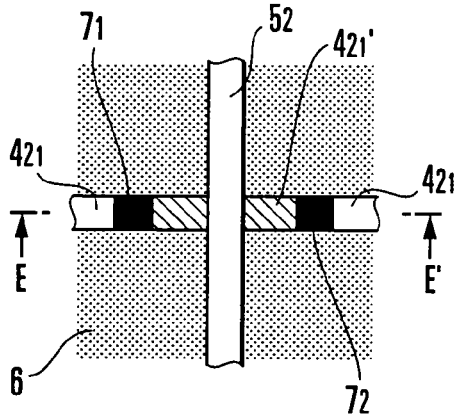
FIG. 10B is a plan view showing an outline of the interconnection structure of the matrix switch shown in FIG. 10A.
Figure 10C:
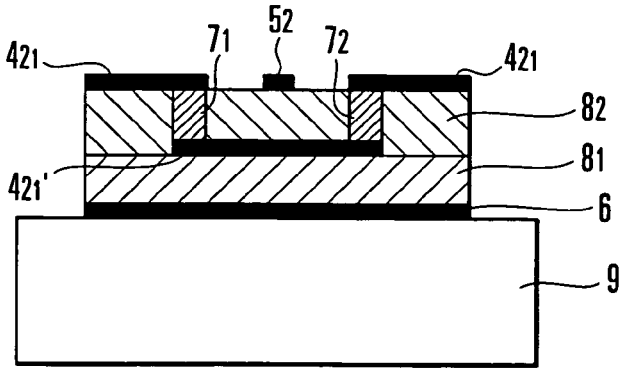
FIG. 10C is a cross-sectional view taken along a line E-E' in FIG. 10B.

The matrix switch shown in FIGS. 10A to 10C is a modification of the matrix switch shown in FIGS. 1 and 3. In this matrix switch, output terminals $\mathbf{2}_1$ to $\mathbf{2}_4$ are gathered on one side of the matrix switch. In addition, first and second conductive lines $\mathbf{4}_{11}$ to $\mathbf{4}_{14}$, $\mathbf{4}_{21}$ to $\mathbf{4}_{24}$, and $\mathbf{5}_1$ to $\mathbf{5}_4$ are formed on a second dielectric layer $\mathbf{8}_2$ in orthogonal directions. Note that portions of the first conductive lines $\mathbf{4}_{11}$ to $\mathbf{4}_{14}$ and $\mathbf{4}_{21}$ to $\mathbf{4}_{24}$ (only a conductive line $\mathbf{4}_{21}$ is shown FIGS. 10B and 10C) are formed on a first dielectric layer $\mathbf{8}_1$ at intersects 16 between the first conductive lines $\mathbf{4}_{11}$ to $\mathbf{4}_{14}$ and $\mathbf{4}_{21}$ to $\mathbf{4}_{24}$ and the second conductive lines $\mathbf{5}_1$ to $\mathbf{5}_4$ except for the connecting portions. These portions of the first conductive lines $\mathbf{4}_{11}$ to $\mathbf{4}_{14}$ and $\mathbf{4}_{21}$ to $\mathbf{4}_{24}$ connect to the remaining portions of the first conductive lines $\mathbf{4}_{11}$ to $\mathbf{4}_{14}$ and $\mathbf{4}_{21}$ to $\mathbf{4}_{24}$ on the second dielectric layer $\mathbf{8}_2$ via through holes $\mathbf{7}_1$ and $\mathbf{7}_2$ and the like formed in the second dielectric layer $\mathbf{8}_2$. Although reference numeral "16" denoting an intersection is attached to only one portion in FIG. 10A, all the symbols "□" with satin-like patterns indicate intersections 16. This applies to FIGS. 13A and 15 to be described later.

This arrangement allows all the transmission lines to have the same arrangement except for the intersections 16. In addition, since the conductor thickness of the uppermost layer can be made larger than that of the remaining layers, the insertion loss can be easily reduced. Note that portions of the second conductive lines $\mathbf{5}_1$ to $\mathbf{5}_4$ may be formed on the first dielectric layer $\mathbf{8}_1$ at the intersections 16 and connect to the remaining portions on the second dielectric layer $\mathbf{8}_2$ via through holes.

The conductive line width on the first dielectric layer $\mathbf{8}_1$ is preferably smaller than that on the second dielectric layer $\mathbf{8}_2$. This can decrease the characteristic impedance difference between the conductive lines on the first dielectric layer $\mathbf{8}_1$ and the conductive lines on the second dielectric layer $\mathbf{8}_2$, and hence can improve the characteristics of the matrix switch. In addition, gathering the output terminals $\mathbf{2}_1$ to $\mathbf{2}_4$ on one side of the matrix switch makes it easy to extract input and output terminals in opposite directions, as shown in FIG. 13.

Figure 11A:
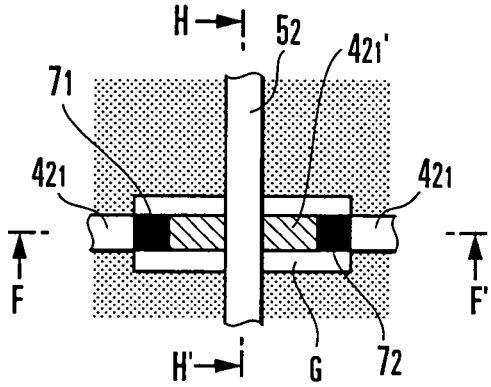
FIG. 11A is a plan view showing an outline of another example of the interconnection structure of the matrix switch according to the third embodiment of the present invention.
Figure 11B:
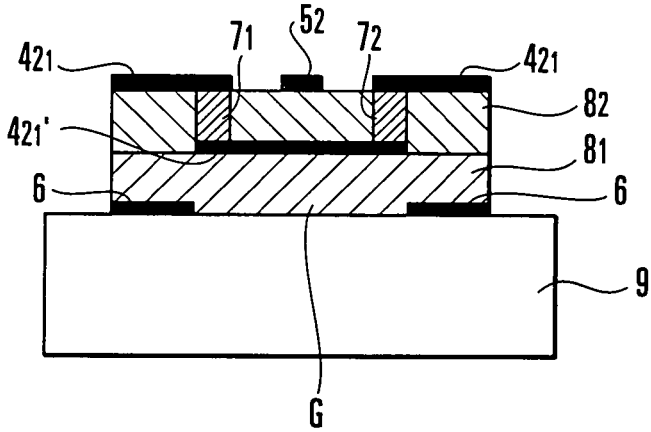
FIG. 11B is a cross-sectional view taken along a line F-F' in FIG. 11A.
Figure 11C:
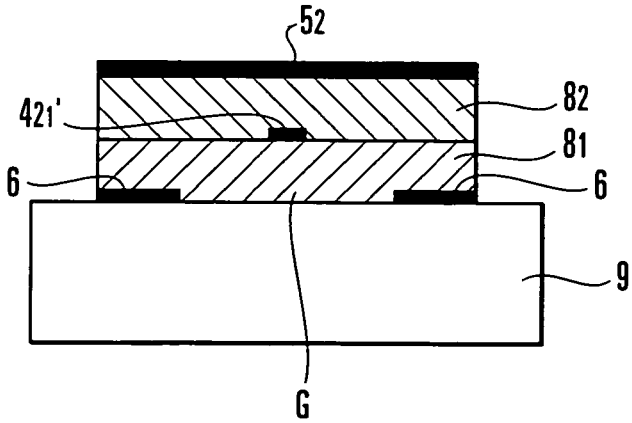
FIG. 11C is a cross-sectional view taken along a line H-H' in FIG. 11A.

The matrix switch shown in FIGS. 11A to 11C is a modification of the matrix switch shown in FIGS. 10A to 10C. In this matrix switch, gaps G are formed in a ground conductor 6 immediately below a conductive line $\mathbf{4}_{21}$ and the like on the first dielectric layer $\mathbf{8}_1$. This reduces the capacitances of the transmission lines, and hence can increase characteristic impedances without decreasing the line widths of a conductive line $\mathbf{42}_{11}$' and the like. Preferably, the conductive line width on the first dielectric layer $\mathbf{8}_1$ is set to be almost equal to that on the second dielectric layer $\mathbf{8}_2$, and the widths of the gaps G are set such that the characteristic impedance of the conductive lines on the first dielectric layer $\mathbf{8}_1$ becomes equal to that of the conductive lines on the second dielectric layer $\mathbf{8}_2$. This makes it possible to further reduce the insertion loss of the matrix switch.

Figure 12A:
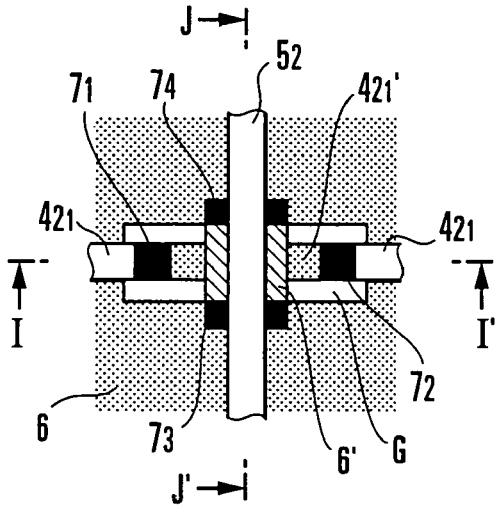
FIG. 12A is a plan view showing an outline of another example of the interconnection structure of the matrix switch according to the third embodiment of the present invention.
Figure 12B:
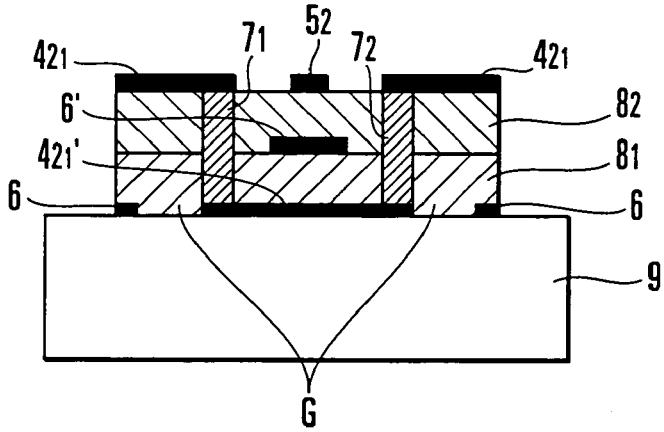
FIG. 12B is a cross-sectional view taken along a line I-I' in FIG. 12A.
Figure 12C:
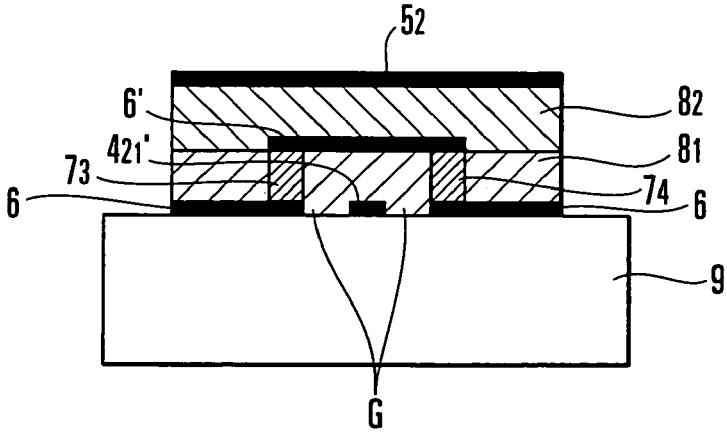
FIG. 12C is a cross-sectional view taken along a line J-J' in FIG. 12A.

The matrix switch shown in FIGS. 12A to 12C is a modification of the matrix switch shown in FIGS. 10A to 10C. In this matrix switch, the gaps G are formed in the ground conductor 6 on a substrate 9 at the intersections between the first conductive lines $\mathbf{4}_{11}$ to $\mathbf{4}_{14}$ and $\mathbf{4}_{21}$ to $\mathbf{4}_{24}$ and the second conductive lines $\mathbf{5}_1$ to $\mathbf{5}_4$ except for the connecting portions. Portions of the first conductive lines $\mathbf{4}_{11}$ to $\mathbf{4}_{14}$ and $\mathbf{4}_{21}$ to $\mathbf{4}_{24}$ (only the conductive line $\mathbf{4}_{21}$ shown in FIGS. 12A to 12C) are formed in the areas on the substrate 9 in which the gaps G are formed (below the first dielectric layer $\mathbf{8}_1$). These portions of the first conductive lines $\mathbf{4}_{11}$ to $\mathbf{4}_{14}$ and $\mathbf{4}_{21}$ to $\mathbf{4}_{24}$ connect to the remaining portions of the first conductive lines $\mathbf{4}_{11}$ to $\mathbf{4}_{14}$ and $\mathbf{4}_{21}$ to $\mathbf{4}_{24}$ on the second dielectric layer $\mathbf{8}_2$ via the through holes $\mathbf{7}_1$ and $\mathbf{7}_2$ formed in the first and second dielectric layers $\mathbf{8}_1$ and $\mathbf{8}_2$. Conductors 6' are formed on the first dielectric layer $\mathbf{8}_1$ immediately below the above intersections. The conductors 6' connect to the ground conductor 6 on the substrate 9 via through holes $\mathbf{7}_3$ and $\mathbf{7}_4$ and the like formed in the first dielectric layer $\mathbf{8}_1$.

This can reduce the intersection capacitance of the conductive lines $\mathbf{4}_{21}$' and $\mathbf{5}_2$, and hence can improve the isolation characteristic of the matrix switch. Note that portions of the second conductive lines $\mathbf{5}_1$ to $\mathbf{5}_4$ may be formed in the areas where the gaps G are formed, and connect to the remaining portions on the second dielectric layer $\mathbf{8}_2$ via through holes.

This embodiment is not limited to the above arrangement, and may be configured to extract the output terminals $\mathbf{2}_1$, $\mathbf{2}_2$, $\mathbf{2}_3$, and $\mathbf{2}_4$ from different sides as in the embodiment shown in FIG. 1. In addition, as in the embodiments shown in FIGS. 8A and 8B and FIGS. 9A and 9B, the gaps G may be formed in the ground conductor 6 immediately below the conductive lines on the second dielectric layer $\mathbf{8}_2$.

Fourth Embodiment

Figure 13A:
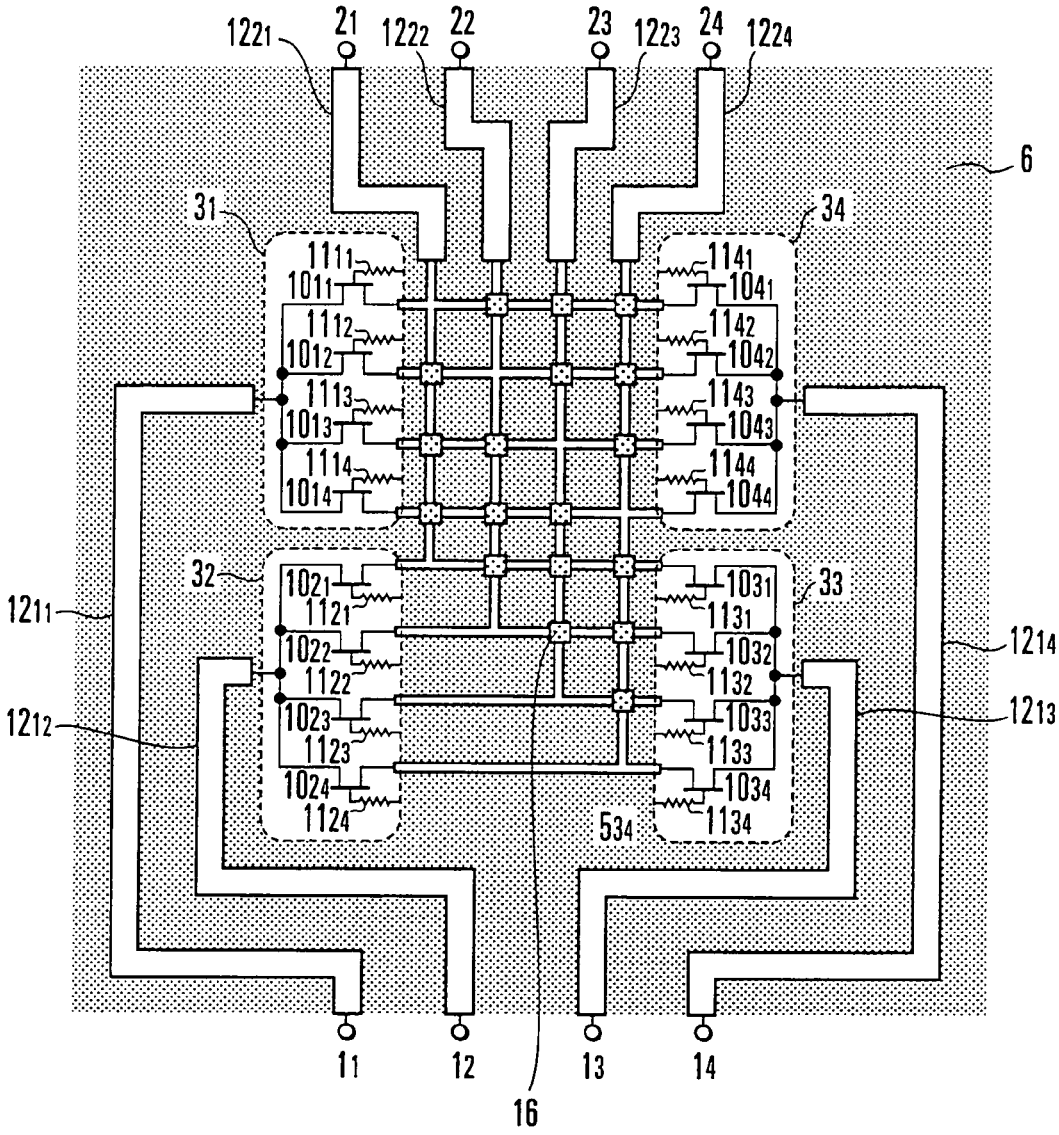
FIG. 13A is a circuit diagram showing a matrix switch according to the fourth embodiment of the present invention.
Figure 13B:
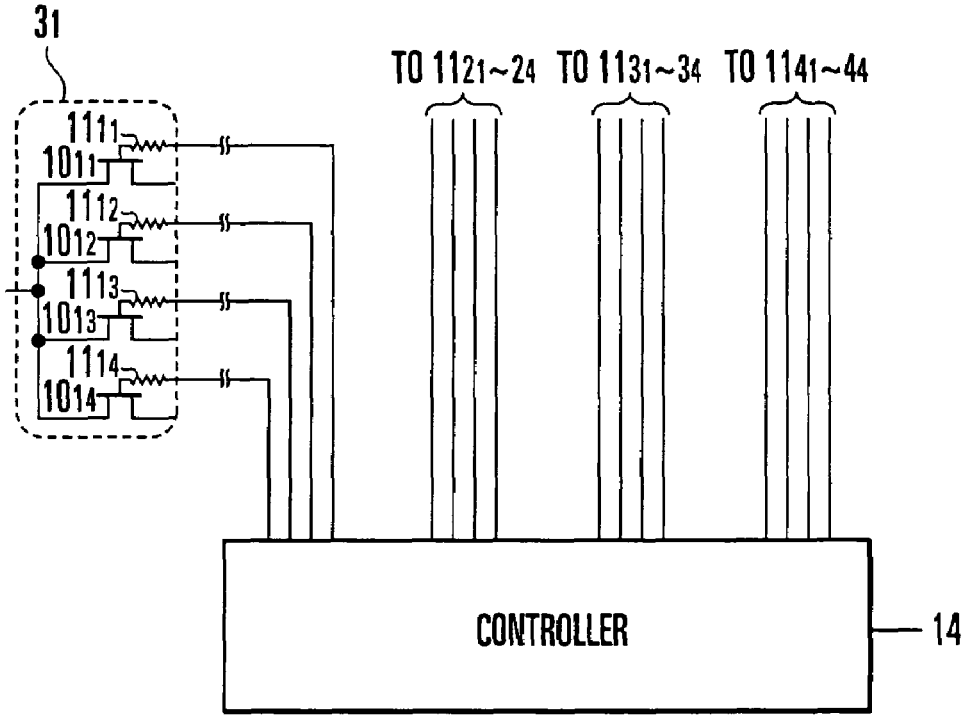
FIG. 13B is a block diagram showing the connection relationship between an SP4T switch and a controller.

As shown in FIG. 13A, a matrix switch according to the fourth embodiment of the present invention is equivalent to the matrix switch shown in FIG. 10 except that SP4T switches $\mathbf{3}_1$ to $\mathbf{3}_4$ comprise field-effect transistors (FETs) $\mathbf{10}_{11}$ to $\mathbf{10}_{14}$, $\mathbf{10}_{21}$ to $\mathbf{10}_{24}$, $\mathbf{10}_{31}$ to $\mathbf{10}_{34}$, and $\mathbf{10}_{41}$ to $\mathbf{10}_{44}$, and resistors $\mathbf{11}_{11}$ to $\mathbf{11}_{14}$, $\mathbf{11}_{21}$ to $\mathbf{11}_{24}$, $\mathbf{11}_{31}$ to $\mathbf{11}_{34}$, and $\mathbf{11}_{41}$ to $\mathbf{11}_{44}$. This arrangement will be described in more detail by taking the SP4T switch $\mathbf{3}_1$ as an example. One of the drain and source electrodes of each of the FETs $\mathbf{10}_{11}$ to $\mathbf{10}_{14}$ connects to the common terminal of the SP4T switch, and the other of the drain and source electrodes of each FET connects to an individual terminal of the SP4T switch. The gate electrodes of the EFTs $\mathbf{10}_{11}$ to $\mathbf{10}_{14}$ connect to a controller 14 via the resistors $\mathbf{11}_{11}$ to $\mathbf{11}_{14}$, as shown in FIG. 13B. Such an FET switch arrangement makes it possible to implement high-speed switching with zero power consumption, and to use a matrix switch by exchanging input and output terminals.

The controller 14 controls the SP4T switches $\mathbf{3}_1$ to $\mathbf{3}_4$ in the above manner. That is, the controller 14 controls each of the SP4T switches $\mathbf{3}_1$ to $\mathbf{3}_4$ such that the common terminal connects to only one of the four individual terminals. In the case of the SP4T switch $\mathbf{3}_1$, for example, $V_H$ is applied to one of the resistors $\mathbf{11}_{11}$ to $\mathbf{11}_{14}$, and $V_L$ is applied to the remaining three resistors. In addition, the matrix switch is controlled as a whole such that four input terminals $\mathbf{1}_1$ to $\mathbf{1}_4$ one-to-one connect to four output terminals $\mathbf{2}_1$ to $\mathbf{2}_4$.

In the matrix switch shown in FIG. 13A, the input terminals $\mathbf{1}_1$ to $\mathbf{1}_4$ and the output terminals $\mathbf{2}_1$ to $\mathbf{2}_4$ are arranged on different sides through the area where first conductive lines $\mathbf{4}_{11}$ to $\mathbf{4}_{14}$ and $\mathbf{4}_{21}$ to $\mathbf{4}_{24}$ and second conductive lines $\mathbf{5}_1$ to $\mathbf{5}_4$ are arranged. Conductive lines (third conductive lines) $\mathbf{12}_{11}$ to $\mathbf{12}_{14}$ of input transmission lines are interposed between the common terminals and the input terminals $\mathbf{1}_1$ to $\mathbf{1}_4$ of the SP4T switches $\mathbf{3}_1$ to $\mathbf{3}_4$. Conductive lines (fourth conductive lines) $\mathbf{12}_{21}$ to $\mathbf{12}_{24}$ of output transmission lines are interposed between end portions and the output terminals $\mathbf{2}_1$ to $\mathbf{2}_4$ of the second conductive lines $\mathbf{5}_1$ to $\mathbf{5}_4$. In this case, bending the third conductive lines $\mathbf{12}_{11}$ to $\mathbf{12}_{14}$ from the common terminals to the opposite side to the output terminals $\mathbf{2}_1$ to $\mathbf{2}_4$ makes it possible to gather the input terminals $\mathbf{1}_1$ to $\mathbf{1}_4$ on the opposite side to the output terminals $\mathbf{2}_1$ to $\mathbf{2}_4$.

The third and fourth conductive lines $\mathbf{12}_{11}$ to $\mathbf{12}_{14}$ and $\mathbf{12}_{21}$ to $\mathbf{12}_{24}$ are arranged on the second dielectric layer $\mathbf{8}_2$ in FIGS. 11B and 11C to form microstrip lines by using the ground conductor 6 and a common ground conductor inside the matrix switch. The third and fourth conductive lines $\mathbf{12}_{11}$ to $\mathbf{12}_{14}$ and $\mathbf{12}_{21}$ to $\mathbf{12}_{24}$ are not required to increase characteristic impedances unlike the first and second conductive lines $\mathbf{4}_{11}$ to $\mathbf{4}_{14}$ and $\mathbf{4}_{21}$ to $\mathbf{4}_{24}$ and $\mathbf{5}_1$ to $\mathbf{5}_4$ for interconnections. This makes it possible to increase the line widths as compared with the first and second conductive lines $\mathbf{4}_{11}$ to $\mathbf{4}_{14}$ and $\mathbf{4}_{21}$ to $\mathbf{4}_{24}$ and $\mathbf{5}_1$ to $\mathbf{5}_4$ so as to match an input/output of 50 O. In this embodiment as well, the first and second conductive lines $\mathbf{4}_{11}$ to $\mathbf{4}_{14}$, $\mathbf{4}_{21}$ to $\mathbf{4}_{24}$, and $\mathbf{5}_1$ to $\mathbf{5}_4$ may have the cross-sectional structures shown in FIGS. 3, 5, 8B, 9B, 11B, 11C, 12B, and 12C.

Fifth Embodiment

A matrix switch according to the fifth embodiment of the present invention is an application of the 4×4 switch shown in FIGS. 1 and 3 to an 8×8 switch. As shown in FIG. 14, this matrix switch includes eight input terminals (first terminals) $\mathbf{1}_1$ to $\mathbf{1}_8$, eight output terminals (second terminals) $\mathbf{2}_1$ to $\mathbf{2}_8$, and eight SP8T switches $\mathbf{13}_1$ to $\mathbf{13}_8$.

The SP8T switches $\mathbf{13}_1$ to $\mathbf{13}_8$ each are a 1×8 switch including one common terminal and eight individual terminals. The eight SP8T switches $\mathbf{13}_1$ to $\mathbf{13}_8$ are grouped in twos to form four switch pairs. More specifically, the SP8T switches $\mathbf{13}_1$ and $\mathbf{13}_8$ constitute the first switch pair; the SP8T switches $\mathbf{13}_2$ and $\mathbf{13}_7$, the second switch pair; the SP8T switches $\mathbf{13}_3$ and $\mathbf{13}_6$, the third switch pair; and the SP8T switches $\mathbf{13}_4$ and $\mathbf{13}_5$, the fourth switch pair. The SP8T switches $\mathbf{13}_1$ and $\mathbf{13}_8$ constitute the first switch pair are spaced apart from each other such that their individual terminals face each other. The SP8T switches $\mathbf{13}_2$ and $\mathbf{13}_7$, $\mathbf{13}_3$ and $\mathbf{13}_6$, and $\mathbf{13}_4$ and $\mathbf{13}_5$ constituting the remaining switch pairs are arranged in the same manner.

In the first switch pair, the eight individual terminals of the SP8T switch $\mathbf{13}_1$ connect to the eight individual terminals of the SP8T switch $\mathbf{13}_8$ via eight first conductive lines $\mathbf{4}_{11}$ to $\mathbf{4}_{18}$. In the second switch pair, the eight individual terminals of the SP8T switch $\mathbf{13}_2$ connect to the eight individual terminals of the SP8T switch $\mathbf{13}_7$ via eight first conductive lines $\mathbf{4}_{21}$ to $\mathbf{4}_{28}$. In the third switch pair, the eight individual terminals of the SP8T switch $\mathbf{13}_3$ connect to the eight individual terminals of the SP8T switch $\mathbf{13}_6$ via eight first conductive lines $\mathbf{4}_{31}$ to $\mathbf{4}_{38}$. In the fourth switch pair, the eight individual terminals of the SP8T switch $\mathbf{13}_4$ connect to the eight individual terminals of the SP8T switch $\mathbf{13}_5$ via eight first conductive lines $\mathbf{4}_{41}$ to $\mathbf{4}_{48}$. The first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ are arranged parallel to each other.

One each of the first conductive lines $\mathbf{4}_{11}$ to $\mathbf{4}_{18}$, one each of the first conductive lines $\mathbf{4}_{21}$ to $\mathbf{4}_{28}$, one each of the first conductive lines $\mathbf{4}_{31}$ to $\mathbf{4}_{38}$, and one each of the first conductive lines $\mathbf{4}_{41}$ to $\mathbf{4}_{48}$, which are different from each other, connect to each other via a corresponding one of eight second conductive lines $\mathbf{5}_1$ to $\mathbf{5}_8$. More specifically, the first conductive lines $\mathbf{4}_{11}$, $\mathbf{4}_{21}$, $\mathbf{4}_{31}$, and $\mathbf{4}_{41}$ connect to each other via the second conductive line $\mathbf{5}_1$; the first conductive lines $\mathbf{4}_{12}$, $\mathbf{4}_{22}$, $\mathbf{4}_{32}$, and $\mathbf{4}_{42}$, via the second conductive line $\mathbf{5}_2$; the first conductive lines $\mathbf{4}_{13}$, $\mathbf{4}_{23}$, $\mathbf{4}_{33}$, and $\mathbf{4}_{43}$, via the second conductive line $\mathbf{5}_3$; the first conductive lines $\mathbf{4}_{14}$, $\mathbf{4}_{24}$, $\mathbf{4}_{34}$, and $\mathbf{4}_{44}$, via the second conductive line $\mathbf{5}_4$; the first conductive lines $\mathbf{4}_{15}$, $\mathbf{4}_{25}$, $\mathbf{4}_{35}$, and $\mathbf{4}_{45}$, via the second conductive line $\mathbf{5}_5$; the first conductive lines $\mathbf{4}_{16}$, $\mathbf{4}_{26}$, $\mathbf{4}_{36}$, and $\mathbf{4}_{46}$, via the second conductive line $\mathbf{5}_6$; the first conductive lines $\mathbf{4}_{17}$, $\mathbf{4}_{27}$, $\mathbf{4}_{37}$, and $\mathbf{4}_{47}$, via the second conductive line $\mathbf{5}_7$; and the first conductive lines $\mathbf{4}_{18}$, $\mathbf{4}_{28}$, $\mathbf{4}_{38}$, and $\mathbf{4}_{48}$, via the second conductive line $\mathbf{5}_8$. The second conductive lines $\mathbf{5}_1$ to $\mathbf{5}_8$ are arranged parallel to each other in a direction to cross (in FIG. 14, a direction perpendicular to) the first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$.

The input terminals $\mathbf{1}_1$ to $\mathbf{1}_8$ respectively connect to the common terminals of the SP8T switches $\mathbf{13}_1$ to $\mathbf{13}_8$. End portions of the second conductive lines $\mathbf{5}_1$ to $\mathbf{5}_8$ are extracted outside the area where the conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ are arranged and connect to output terminals $\mathbf{2}_1$ to $\mathbf{2}_8$. The SP8T switches $\mathbf{13}_1$ to $\mathbf{13}_8$ are controlled as a whole such that the eight input terminals $\mathbf{1}_1$ to $\mathbf{1}_8$ one-to-one connect to the eight output terminals $\mathbf{2}_1$ to $\mathbf{2}_8$.

The first conductive lines $\mathbf{4}_{11}$ to $\mathbf{4}_{18}$, $\mathbf{4}_{21}$ to $\mathbf{4}_{28}$, $\mathbf{4}_{11}$ to $\mathbf{4}_{38}$, and $\mathbf{4}_{41}$ to $\mathbf{4}_{48}$ and the second conductive lines $\mathbf{5}_1$ to $\mathbf{5}_8$ constitute microstrip lines together with a ground conductor 6 formed on a substrate 9 and a first dielectric layer $\mathbf{8}_1$ and a second dielectric layer $\mathbf{8}_2$ sequentially formed on the ground conductor 6. The first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ are arranged on the first dielectric layer $\mathbf{8}_1$, and the second conductive lines $\mathbf{5}_1$ to $\mathbf{5}_8$ are arranged on the second dielectric layer $\mathbf{8}_2$. The first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ and the second conductive lines $\mathbf{5}_1$ to $\mathbf{5}_8$ connect to each other via through holes $\mathbf{7}_1$ formed in the second dielectric layer $\mathbf{8}_2$ at connecting portions 15 indicated by "■" in FIG. 14.

This arrangement can decrease the number of conductive lines existing between the opposite switches of each switch pair from 64 in the prior art shown in FIG. 20 with n=8 to eight (the second conductive lines $\mathbf{5}_1$ to $\mathbf{5}_8$). Using conductive lines with the same line width and the same line interval, therefore, makes it possible to decrease the interval between the two SP8T switches constituting each of the first to fourth switch pairs to about ⅛ that in the prior art. This can decrease the length of open stubs which exist in sevens for each of the output terminals $\mathbf{2}_1$ to $\mathbf{2}_8$ during switching operation to about 1/56 that in the prior art. For this reason, this arrangement allows operation in a bandwidth 50 times or more broader than that in the conventional arrangement with n=8 from which output-side SP8T switches are removed. Furthermore, since the length of the transmission line between input and output terminals in the ON state decreases, insertion loss can be reduced, and the path dependency of insertion loss can be reduced.

In addition, the above arrangement can decrease the number of interconnection intersections from 784 to 180 as compared with the prior art shown in FIG. 20 with n=8. Furthermore, as shown in FIG. 3, the ground conductor 6 and the dielectric layers $\mathbf{8}_1$ and $\mathbf{8}_2$ are sequentially formed on the substrate 9, and the thicknesses of the dielectric layers $\mathbf{8}_1$ and $\mathbf{8}_2$ are set to several μm to several ten μm. This structure makes it possible to maintain high inter-line isolation even if the line interval is decreased as compared with microstrip lines using a substrate lower surface ground and coplanar waveguides formed on a substrate upper surface. Therefore, a switch with a broader bandwidth can be implemented. Moreover, the above structure can increase a characteristic impedance with a narrow line interval as compared with coplanar waveguides, and hence makes it easy to reduce the capacitance caused by an open stub, thereby improving return loss.

According to the matrix switch shown in FIG. 14, it was confirmed that an 8×8 switch with a bandwidth of about 10 GHz could be implemented by setting the line widths of the first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ and the second conductive lines $\mathbf{5}_1$ to $\mathbf{5}_8$ to about 5 to 10 μm, the thicknesses of the lines to about 1 to 5 μm, and the thicknesses of the first and second dielectric layers $\mathbf{8}_1$ and $\mathbf{8}_2$ to about 2 to 5 μm (dielectric constant: about 3).

Note that this embodiment is not limited to the arrangement shown in FIG. 14, and the second conductive lines $\mathbf{5}_1$ to $\mathbf{5}_8$ may be formed on the first dielectric layer $\mathbf{8}_1$, and the first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ may be formed on the second dielectric layer $\mathbf{8}_2$ as in the 4×4 switch shown in FIGS. 4 and 5. As shown in FIGS. 8B and 9B, the gaps G may be formed in the ground conductor 6.

Sixth Embodiment

Figure 15:
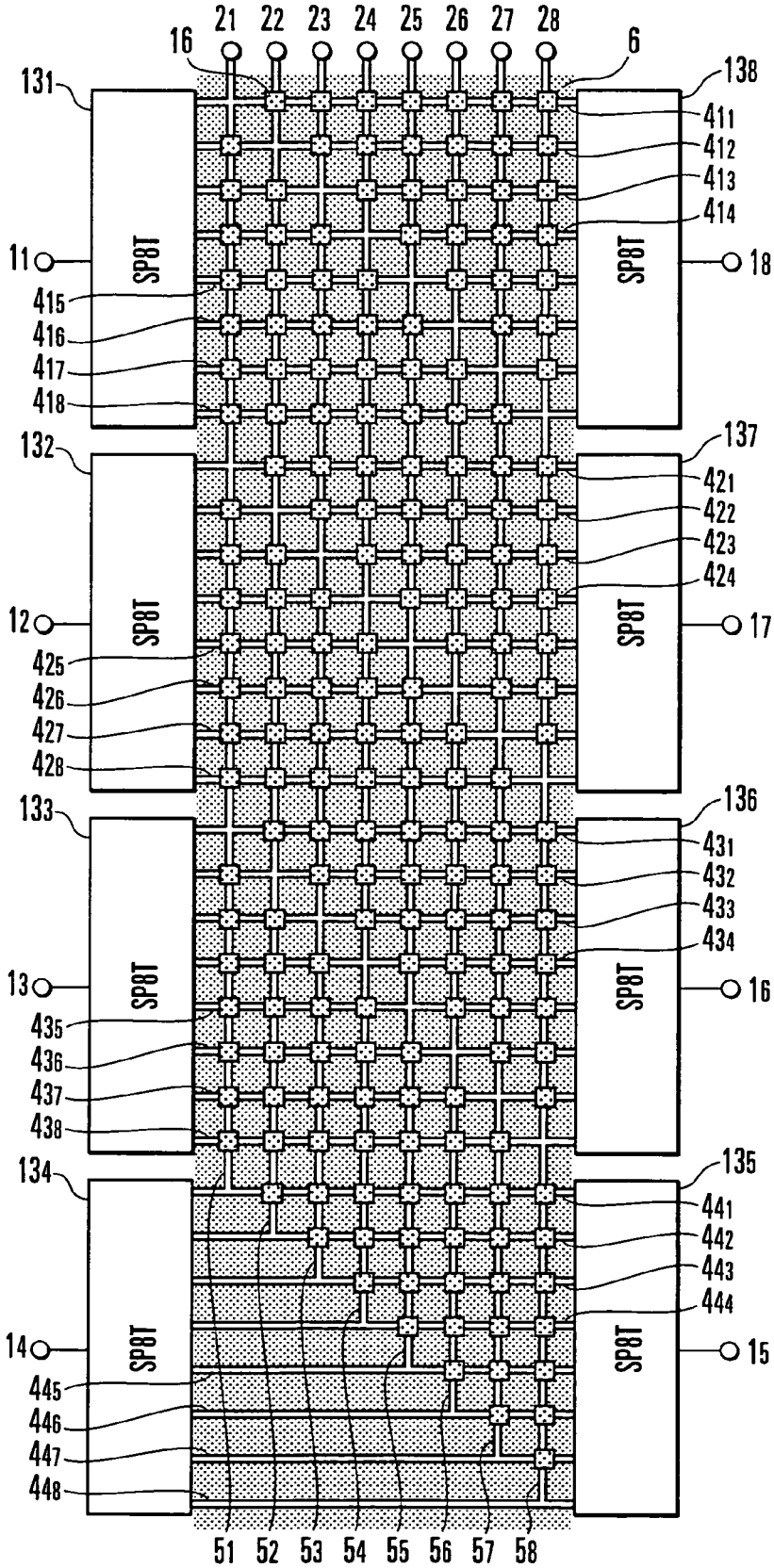
FIG. 15 is a block diagram showing the arrangement of a matrix switch according to the sixth embodiment of the present invention.

The matrix switch shown in FIG. 15 is a modification of the matrix switch shown in FIG. 14. According to this matrix switch, output terminals $\mathbf{2}_1$ to $\mathbf{2}_8$ are gathered on one side of the matrix switch. The first and second conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, $\mathbf{4}_{41}$ to $\mathbf{4}_{48}$, and $\mathbf{5}_1$ to $\mathbf{5}_8$ are formed on a second dielectric layer $\mathbf{8}_2$ in orthogonal directions. Note, however, that portions of the first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ are formed on a first dielectric layer $\mathbf{8}_1$ at intersections 16 of the first conductive lines $\mathbf{4}_{11}$ to $\mathbf{4}_{18}$, $\mathbf{4}_{21}$ to $\mathbf{4}_{28}$, $\mathbf{4}_{31}$ to $\mathbf{4}_{38}$, and $\mathbf{4}_{41}$ to $\mathbf{4}_{48}$ and the second conductive lines $5_1$ to 58 except for the connecting portions. These portions connect to the remaining portions of the first conductive lines $4_{11}$ to $4_{18}$, $4_{21}$ to $4_{28}$, $4_{31}$ to $4_{38}$, and $4_{41}$ to $4_{48}$ on the second dielectric layer $8_2$ via through holes $7_1$ and $7_2$ formed in the second dielectric layer $8_2$.

Such an arrangement allows all the transmission lines to have the same arrangement except at the intersections 16. In addition, the conductor thickness of the upper layer can be made thicker than those of the remaining layers, thus making it easy to reduce insertion loss. Note that portions of the second conductive lines $5_1$ to $5_8$ may be formed on the first dielectric layer $8_1$ at the intersections 16 and connect to the remaining portions on the second dielectric layer $8_2$ via through holes.

The conductive line width on the first dielectric layer $8_1$ is preferably smaller than that on the second dielectric layer $8_2$. This makes it possible to reduce the characteristic impedance difference between the conductive lines on the first dielectric layer $8_1$ and the conductive lines on the second dielectric layer $8_2$ and improve the characteristics of the matrix switch. In addition, gathering the output terminals $2_1$ to $2_8$ on one side of the matrix switch facilitates extraction of input and output terminals in opposite directions.

Note that this embodiment is not limited to the arrangement shown in FIG. 15. As in the 4×4 switch shown in FIG. 11, the gaps G may be formed in a ground conductor 6 immediately below portions (e.g., a conductive line $4_{21}$') of the conductive lines on the first dielectric layer $8_1$. Alternatively, as in the 4×4 switch shown in FIG. 12, conductors 6' may be formed below the intersections 16 of the first conductive lines $4_{11}$ to $4_{18}$, $4_{21}$ to $4_{28}$, $4_{31}$ to $4_{38}$, and $4_{41}$ to $4_{48}$ and the second conductive lines $5_1$ to $5_8$ and connect to the ground conductor 6 on a substrate 9 via through holes $7_3$ and $7_4$.

As shown in FIG. 14, the output terminals $2_1$ to $2_4$ and $2_5$ to $2_8$ may be extracted from different sides. In addition, as shown in FIGS. 8B and 9B, the gaps G may be formed in the ground conductor 6 immediately below the conductive lines on the first dielectric layer $8_1$. Furthermore, as shown in FIG. 13, each SP8T switch may comprise eight FETs.

Other Embodiments

The SP4T switches $3_1$ to $3_4$ and SP8T switches $13_1$ to $13_8$ in the above embodiments may comprise micro-mechanical switches (MEMS (Micro-Electro-Mechanical Systems) switches) instead of FETs. Using MEMSs increases the control voltage and prolongs the switching time as compared with a case wherein FETs are used, but can achieve the low insertion loss and high isolation of switches.

In addition, part or all of the above matrix switch is preferably integrated on a semiconductor substrate. That is, a semiconductor substrate is preferably used as a substrate 9.

The above embodiments have exemplified the dielectric layer 8 with the two-layer structure. However, the present invention can use a dielectric layer with a single-layer structure or a dielectric layer with a multi-layer structure comprising three or more layers. When a dielectric layer with a single-layer structure is to be used, first and second conductive lines are arranged on the dielectric layer and the substrate 9 immediately below the dielectric layer. When a dielectric layer comprising three or more layers is to be used, first and second conductive lines may be separately arranged on the three or more layers.

The above embodiments have exemplified the case wherein the first conductive lines $4_{11}$ to $4_{14}$ and $4_{21}$ to $4_{24}$ and the second conductive lines $5_1$ to $5_4$ constitute microstrip lines together with the dielectric layer 8 and the ground conductor 6. However, either the first conductive lines $4_{11}$ to $4_{14}$ and $4_{21}$ to $4_{24}$ or the second conductive lines $5_1$ to $5_4$ may constitute coplanar waveguides together with a ground conductor formed in the same plane.

Figure 16:
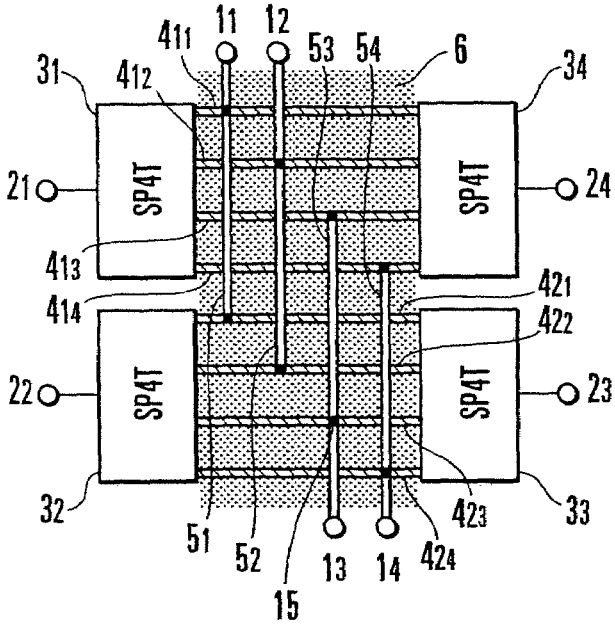
FIG. 16 is a block diagram showing a modification of the matrix switch shown in FIG. 1.

In addition, in the 4×4 switch described above, the input terminals $1_1$ to $1_4$ and the output terminals $2_1$ to $2_4$ may be exchanged. That is, the output terminals $2_1$ to $2_4$ may be used as input terminals, and the input terminals $1_1$ to $1_4$ may be used as output terminals. For example, FIG. 16 shows the arrangement obtained by exchanging the input terminals $1_1$ to $1_4$ and the output terminals $2_1$ to $2_4$ in the matrix switch shown in FIG. 1. In this case, the output terminals $2_1$ to $2_4$ become the first terminals, and the input terminals $1_1$ to $1_4$ become the second terminals. Likewise, in the 8×8 switch described above, the input terminals $1_1$ to $1_8$ and the output terminals $2_1$ to $2_8$ may be exchanged.

The above description has exemplified the case wherein the present invention is applied to the 4×4 switch and the 8×8 switch. However, the present invention is not limited to this, and may be applied to an n×n switch (n is an even number equal to or more than 2). An n×n switch includes n SPnT switches (1×n switches) grouped in twos to form switch pairs, first conductive lines arranged in ns for each switch pair, and n second conductive lines.

Figure 17A:
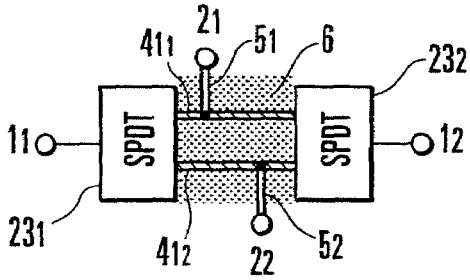
FIG. 17A is a block diagram showing an example of the arrangement of a 2×2 switch to which the present invention is applied.
Figure 17B:
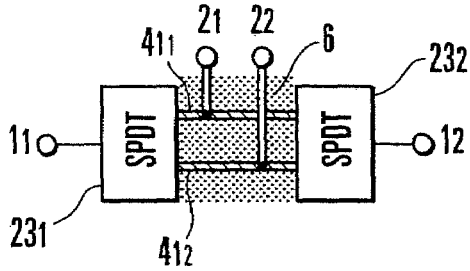
FIG. 17B is a block diagram showing another example of the arrangement of the 2×2 switch to which the present invention is applied.
Figure 18:
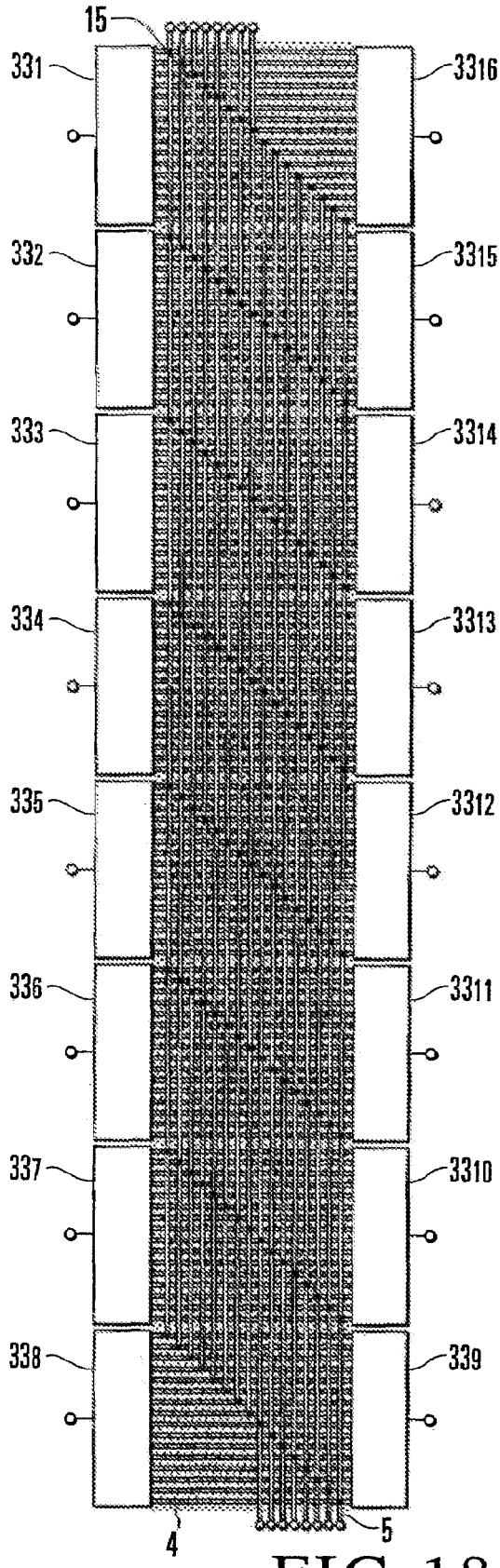
FIG. 18 is a block diagram showing an example of the arrangement of a 16×16 switch to which the present invention is applied.
Figure 19:
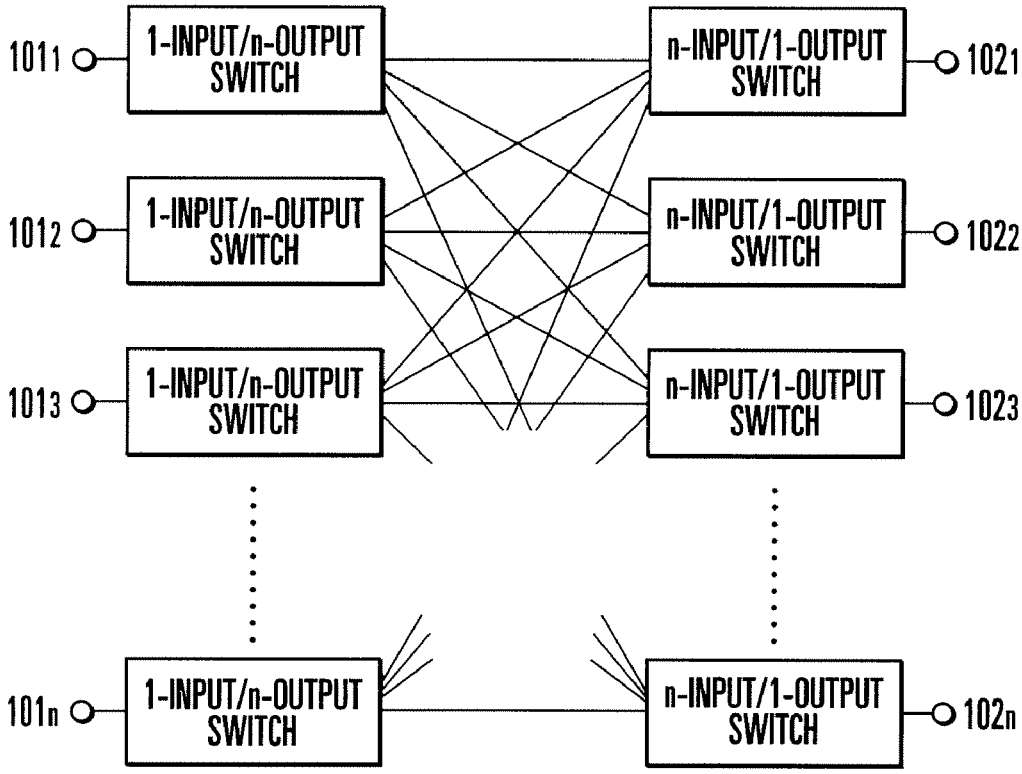
FIG. 19 (PRIOR ART)
FIG. 19 is a block diagram showing the arrangement of a conventional n-input/n-output switch.

For example, as shown in FIGS. 17A and 17B, a 2×2 switch includes two SPDT switches $23_1$ and $23_2$, two first conductive lines $4_{11}$ and $4_{12}$, and two second conductive lines $5_1$ and $5_2$. In the 2×2 switch shown in FIG. 17A, output terminals $2_1$ and $2_2$ are arranged on opposite sides of the area where first and second conductive lines $4_{11}$, $4_{12}$, $5_1$, and $5_2$ are arranged. In the 2×2 switch shown in FIG. 17B, output terminals $2_1$ and $2_2$ are arranged on the same side. In addition, as shown in FIG. 18, a 16×16 switch includes 16 SP16T switches $33_1$ to $33_{16}$ constituting eight switch pairs, first conductive lines 4 arranged in 16 s for each switch pair, and 16 second conductive lines 5.

The above SPnT switch is a switch which functions as both a 1-input/n-output switch and an n-input/1-output switch. The present invention can use a switch having no bidirectionality instead of such an SPnT switch. More specifically, a matrix switch like that shown in FIG. 1 can use 1-input/n-output switches, and a matrix switch like that shown in FIG. 16 can use n-input/1-output switches.

INDUSTRIAL APPLICABILITY

The matrix switch according to the present invention can be used for a 10 GbE router, network switch, high-speed video signal switcher, optical cross-connect, protection switch, and the like.

The invention claimed is:

1. A matrix switch comprising:

a plurality of 1×n switches which are grouped in twos to form switch pairs where n is an even number not less than 4;

first conductive lines arranged to connect the two switches of each switch pair via n first conductive lines;

n second conductive lines which respectively connect to different lines of said first conductive lines which are respectively arranged on the switch pairs, so that one each of the first conductive lines of each switch pair is connected to one each of the first conductive lines of all other switch pairs;

a dielectric layer with a multi-layer structure on which said first conductive lines and said second conductive lines are separately arranged on not less than two layers of the multi-layer structure; and a ground conductor which forms a transmission line together with at least one of said first conductive lines and said second conductive lines and said dielectric layer, wherein each said 1×n switch comprises one common terminal and n individual terminals arranged on a side different from that of the common terminal, each said two 1×n switches forming the switch pair are disposed such that individual terminals of 1×n switches are spaced apart from each other to face each other, said first conductive lines connect the respective individual terminals of each said two 1×n switches to each other, where the matrix switch further comprises:

n first terminals which connect to the common terminals of said 1×n switches, n second terminals which connect to said second conductive lines, the terminals of the one of said first terminals and said second terminals are input terminals to which signals are input, and the terminals of the other of said first terminals and said second terminals are output terminals from which signals are output.

2. A matrix switch according to claim 1, further comprising a control unit which connects to said 1×n switches and controls said 1×n switches to one-to-one connect said n first terminals to said n second terminals.

3. A matrix switch according to claim 1, wherein said dielectric layer comprises a first dielectric layer and a second dielectric layer stacked on the first dielectric layer, said first conductive lines are arranged on one of the first dielectric layer and the second dielectric layer, said second conductive lines are arranged on one of the first dielectric layer and the second dielectric layer which is different from the layer on which said first conductive lines are arranged in a direction to cross said first conductive lines, and the second dielectric layer comprises through holes which connect said first conductive lines to said second conductive lines.

4. A matrix switch according to claim 1, wherein said dielectric layer comprises a first dielectric layer and a second dielectric layer stacked on the first dielectric layer, said first conductive lines and said second conductive lines are arranged on one of the first dielectric layer and the second dielectric layer in crossing directions, a portion of one of said first conductive line and said second conductive line is arranged on a layer different from a layer on which a remaining portion is arranged, at an intersection of said first conductive line and said second conductive line except for a connecting portion, and the second dielectric layer comprises a through hole which connects said portion of one of said first conductive line and said second conductive line to said remaining portion.

5. A matrix switch according to claim 1, wherein said dielectric layer comprises a first dielectric layer and a second dielectric layer stacked on the first dielectric layer, said first conductive lines and said second conductive lines are arranged on the second dielectric layer in crossing directions, a portion of one of said first conductive line and said second conductive line is arranged below the first dielectric layer at an intersection of said first conductive line and said second conductive line except for a connecting portion, the first dielectric layer and the second dielectric layer comprise through holes which connect said portion of one of said first conductive line and said second conductive line to said remaining portion, and the matrix switch further comprises a conductor which is arranged on the first dielectric layer at the intersection and connects to said ground conductor.

6. A matrix switch according to claim 1, wherein said ground conductor is formed on a substrate, and said dielectric layer is formed on said ground conductor.

7. A matrix switch according to claim 6, wherein said ground conductor comprised a gap immediately below at least one of said first conductive line and said second conductive line.

8. A matrix switch according to claim 1, wherein said dielectric layer comprises a first dielectric layer and a second dielectric layer stacked on the first dielectric layer, portions of said first conductive line and said second conductive line are arranged on the second dielectric layer, remaining portions of said first conductive line and said second conductive line are arranged on the first dielectric layer, and said ground conductor is formed below the first dielectric layer.

9. A matrix switch according to claim 8, wherein a width of a line portion arranged on the first dielectric layer is smaller than a width of a line portion arranged on the second dielectric layer, and a characteristic impedance of the line portion arranged on the first dielectric layer is the same as a characteristic impedance of the line portion arranged on the second dielectric layer.

10. A matrix switch according to claim 8, wherein said ground conductor comprises a gap immediately below a line portion arranged on at least one of the first dielectric layer and the second dielectric layer, and a width of the gap is set such that a characteristic impedance of a line portion arranged on the first dielectric layer becomes equal to a characteristic impedance of the line portion arranged on the second dielectric layer.

11. A matrix switch according to claim 1, further comprising a third conductive line which connects the common terminal of said 1×n switch to said first terminal, and a fourth conductive line which connects an end portion of said second conductive line to said second terminal, wherein said first terminal and said second terminal are arranged on different sides of an area where said first conductive line and said second conductive line are arranged, and said third conductive line bends from the common terminal to said first terminal.

12. A matrix switch according to claim 11, wherein widths of said third conductive line and said fourth conductive line are larger than widths of said first conductive line and said second conductive line.

13. A matrix switch according to claim 1, wherein said 1×n switch comprises one common terminal, n individual terminals, and n field-effect transistors, and the field-effect transistor has one of a drain electrode and a source electrode connected to the common electrode and the other of the drain electrode and the source electrode connected to the individual terminal.

14. A matrix switch according to claim 1, wherein said 1×n switch comprises a mechanical switch.

15. A matrix switch according to claim 1, wherein n is 4.

16. A matrix switch according to claim 1, wherein n is 8.

17. A matrix switch according to claim 1, further comprising a control unit which connects to said 1×n switches and controls said 1×n switches to one-to-m (m is an integer not less than 2 and not more than n) connect said n first terminals to said n second terminals.

* * * * *

UNITED STATES PATENT AND TRADEMARK OFFICE

CERTIFICATE OF CORRECTION

PATENT NO. : 7,557,674 B2
APPLICATION NO. : 11/587287
DATED : July 7, 2009
INVENTOR(S) : Hideki Kamitsuna It is certified that error appears in the above-identified patent and that said Letters Patent is hereby corrected as shown below:

Column 15, Claim 1, line 13, delete “where” insert --wherein--

Signed and Sealed this
Twelfth Day of July, 2011

David J. Kappos

David J. Kappos
*Director of the United States Patent and Trademark Office*